US009062524B2

(12) United States Patent
Calvo et al.

(10) Patent No.: US 9,062,524 B2
(45) Date of Patent: Jun. 23, 2015

(54) METHOD AND APPARATUS FOR CORRECTING DATA POINTS ACQUIRED DURING WELL DRILLING

(75) Inventors: Mariano Calvo, Redwood Meadows (CA); Steven Sheldon, Calgary (CA); Craig Bye, Calgary (CA)

(73) Assignee: Pason Systems Corp., Calgary (CA)

( * ) Notice: Subject to any disclaimer, the term of this patent is extended or adjusted under 35 U.S.C. 154(b) by 1093 days.

(21) Appl. No.: 13/015,148

(22) Filed: Jan. 27, 2011

(65) Prior Publication Data

US 2011/0185246 A1 Jul. 28, 2011

Related U.S. Application Data

(60) Provisional application No. 61/298,881, filed on Jan. 27, 2010.

(51) Int. Cl.
*H04L 1/00* (2006.01)
*E21B 44/00* (2006.01)

(52) U.S. Cl.
CPC ..... *E21B 44/00* (2013.01)

(58) Field of Classification Search
CPC .... H04L 1/0045; H04L 1/0057; H04L 1/0061
USPC ..... 714/746
See application file for complete search history.

(56) References Cited

U.S. PATENT DOCUMENTS

| | | | | |
|---|---|---|---|---|
| 6,014,343 | A * | 1/2000 | Graf et al. | 367/38 |
| 6,272,434 | B1 * | 8/2001 | Wisler et al. | 702/9 |
| 6,408,953 | B1 * | 6/2002 | Goldman et al. | 175/39 |
| 7,184,991 | B1 * | 2/2007 | Wentland et al. | 706/45 |
| 7,424,365 | B2 * | 9/2008 | Hassan et al. | 702/7 |
| 7,756,694 | B2 * | 7/2010 | Graf et al. | 703/10 |
| 8,145,444 | B1 * | 3/2012 | Bickford et al. | 702/85 |

* cited by examiner

*Primary Examiner* — Esaw Abraham
(74) *Attorney, Agent, or Firm* — Katten Muchin Rosenman LLP

(57) ABSTRACT

Described herein are a method, apparatus and computer readable medium for correcting data points acquired during well drilling. The data points are typically stored in a text file that is accessible by a processor. The processor applies one or more tags to the data points, with each of the tags corresponding to a characteristic of the data points. The processor then identifies one or more data faults in the data points using the one or more tags. Each data fault is indicative of inaccurate data in the data points; i.e., data that does not accurately represent the well as drilled. Following identification of the one or more data faults, the processor corrects one or more of the data faults. The resulting corrected, or cleaned, data is more indicative of the well as actually drilled than the uncorrected data. The processor can be connected to a computer readable medium that stores the statements and instructions that the processor executes.

35 Claims, 19 Drawing Sheets

METHOD AND APPARATUS FOR CORRECTING DATA POINTS ACQUIRED DURING WELL DRILLING

CROSS REFERENCE TO RELATED APPLICATION

Pursuant to 35 U.S.C. §119(e), this application claims the benefit of provisional U.S. Patent Application No. 61/298,881 filed Jan. 27, 2010 and entitled "Method and Apparatus for Correcting Data Points Acquired During Well Drilling," which is hereby incorporated by reference in its entirety.

TECHNICAL FIELD

The present disclosure is directed at a method and apparatus for correcting data points acquired during well drilling.

BACKGROUND

Large amounts of data are generated during drilling of oil and gas wells. This data can be automatically recorded using any one of several data recording devices known in the art; the Pason™ Electronic Drilling Recorder is one such device. During drilling, the data recording device records various parameters that are material for and that are intermittently measured during well drilling. The parameters can include:

- the hole depth of the well;
- the depth of the drill bit;
- the on bottom rate of penetration;
- the weight on the drill bit;
- the rotations per minute of the drill string;
- the rotary torque applied to the drill string; and
- the total pump output of the pumps responsible for pumping drilling mud into the well.

The parameters are typically recorded intermittently every several seconds or every several centimeters of drilling. The parameters can be recorded in the form of data points in a text file for subsequent use by drilling engineers. The data points are usable if they accurately represent how the well was drilled.

Some of the data points may not be representative of how the well was drilled. For example, during drilling the drill string may break, which can result in the data recording device continuing to record a positive value for the rotations per minute of the drill string notwithstanding that the well is not being drilled. Such erroneous data can hinder the work of the drilling engineer.

Accordingly, there exists a need for an apparatus and method for correcting data points acquired during well drilling.

SUMMARY

According to a first aspect, there is provided a computer implemented method for correcting data points acquired during well drilling. The method includes applying a tag to one or more of the data points wherein the tag corresponds to a characteristic of the one or more of the data points; identifying a data fault indicative of inaccurate data in the one or more of the data points associated with the tag; and correcting the data fault. One or more tags may be applied to any subset of the one or more of the data points. Each of the tags may correspond to a different characteristic of the one or more of the data points. Similarly, the method may include identifying one or more data faults, and each of the multiple data faults may be indicative of a different inaccuracy in the one or more data points associated with the tag. One or more of the data faults may be corrected.

Applying the one or more tags can include any one or more of the following and any and all combinations of:

- applying a null tag to any one or more of the data points with which no usable data is associated;
- applying a measured time difference tag to any one or more of the data points for which a difference in measured time between the one or more of the data points and a data point immediately previously recorded to the one of the data points exceeds a pre-determined measured time threshold;
- applying a calculated time difference tag to any one or more of the data points for which a difference in measured time and calculated time for the one or more of the data points exceeds a pre-determined calculated time threshold;
- applying a weight on bit tag to any one or more of the data points for which a difference in weight on bit between the one or more of the data points and a data point previously recorded to the one or more of the data points exceeds a pre-determined weight on bit threshold;
- applying a rotations per minute tag to any one or more of the data points for which a difference in rotations per minute between the one or more of the data points and a data point previously recorded to the one or more of the data points exceeds a pre-determined rotations per minute threshold;
- applying a total pump output tag to any one or more of the data points for which a difference in total pump output between the one or more of the data points and a data point previously recorded to the one or more of the data points exceeds a pre-determined total pump output threshold;
- applying a sliding tag to any one or more of the data points that were measured during sliding drilling;
- applying a duplicate tag to any one or more of the data points that have identical depth measurements;
- applying a jump tag to any one or more of the data points wherein a change in depth between the one or more of the data points and a data point immediately previously recorded to the one or more of the data points exceeds a pre-determined depth interval; and
- applying an invalid tag to any one or more of the data points wherein values of rate of penetration, weight on bit or rotations per minute associated with the one or more of the data points are outside pre-determined thresholds.

Identifying one or more data faults can include any one or more of the following and any and all combinations of:

- identifying as a null point any one of the one or more data points tagged as null;
- identifying as a sliding point any one of the one or more data points tagged as sliding;
- identifying as an invalid point any one of the one or more data points that have been tagged as invalid;
- identifying, from any one or more of the data points tagged as duplicate, first and second legs of duplicate points and assigning a score to the first and second legs of duplicate points indicative of data reliability;
- identifying a data fault comprises identifying as a jump point any one or more of the data points tagged as jump and determining a number of data points to be inserted prior to the jump point. The number of data points to be inserted equals the change in depth between the jump point and a data point immediately previously recorded to the jump point, divided by the pre-determined depth interval;

identifying as a truncation point any one or more of the data points recorded at the beginning or end of drilling that are tagged as invalid, for which a measured time exceeds a pre-determined measured time threshold, or for which a difference between the measured time and a calculated time exceeds a pre-determined difference threshold, until a certain number of points that are valid, for which the measured time is within the pre-determined measured time threshold and for which the difference between the measured and calculated times is within the pre-determined difference threshold are counted; and identifying as a problematic point any one or more of the data points that are indicative of a stoppage in drilling.

Correcting the data faults can include any one or more of the following and any and all combinations of:

correcting the duplicate points by deleting the one of the duplicate legs whose score is more indicative of unreliability;

smoothing one or more of the data points;

correcting the jump point by inserting the number of data points to be inserted of data points prior to the jump point. Each of the data points that is inserted may be identical to a valid data point recorded prior to the jump point. The valid data point may be recorded immediately prior to the data point associated with the data fault;

correcting the problematic point by replacing the problematic point with a valid data point recorded prior to the problematic point. The valid data point may be recorded immediately prior to the data point associated with the data fault;

correcting the null point by replacing the null point with a valid data point recorded prior to the null point. The valid data point may be recorded immediately prior to the data point associated with the data fault;

correcting the sliding point by replacing the sliding point with a valid data point recorded prior to the sliding point. The valid data point may be recorded immediately prior to the data point associated with the data fault; and correcting the invalid point by replacing the invalid point with a valid data point recorded prior to the invalid point. The valid data point may be recorded immediately prior to the data point associated with the data fault.

Reference to a "valid data point" includes reference to a data point that is not tagged as null, sliding or invalid.

The tags can be applied in the following order: null tags, measured time tags, calculated time tags, weight on bit tags, rotations per minute tags, total pump output tags, sliding tags, jump tags, duplicate tags, and then invalid tags. The tags do not have to be applied in this order, and when this order is utilized not all of the different types of tags need to be applied.

Identifying and correcting the data faults can be done in the following order: identifying null points and sliding points, identifying and correcting truncation points, identifying and correcting duplicate points and jump points, identifying and correcting problematic points, correcting the null points, identifying and correcting invalid points, identifying and correcting smoothing points, and then correcting the sliding points. Identification and correction does not have to be performed in this order, and when this order is utilized not all of the data faults need to be either identified or corrected.

According to another aspect, there is provided a computer readable medium having encoded thereon statements and instructions for execution by a processor to carry out a method according to any of the above aspects. The computer readable medium may be a non-transitory computer readable medium that excludes propagating electromagnetic waves but that includes all other types of computer readable media such as but not limited to any form of disk or semiconductor based memory such as random access memory, flash memory, read only memory, hard disk drives, optical drives and optical drive media, flash drives, and any other suitable form of computer readable medium that can be used for storage as is known to skilled persons.

Another to a further aspect, there is provided an apparatus for correcting data points acquired during well drilling. The apparatus includes a processor; and a memory communicatively coupled to the processor. The memory has encoded thereon statements and instructions for execution by the processor to carry out a method according to any of the above aspects.

BRIEF DESCRIPTION OF THE FIGURES

In the accompanying drawings, which illustrate one or more exemplary embodiments.

DETAILED DESCRIPTION

Figure 1:
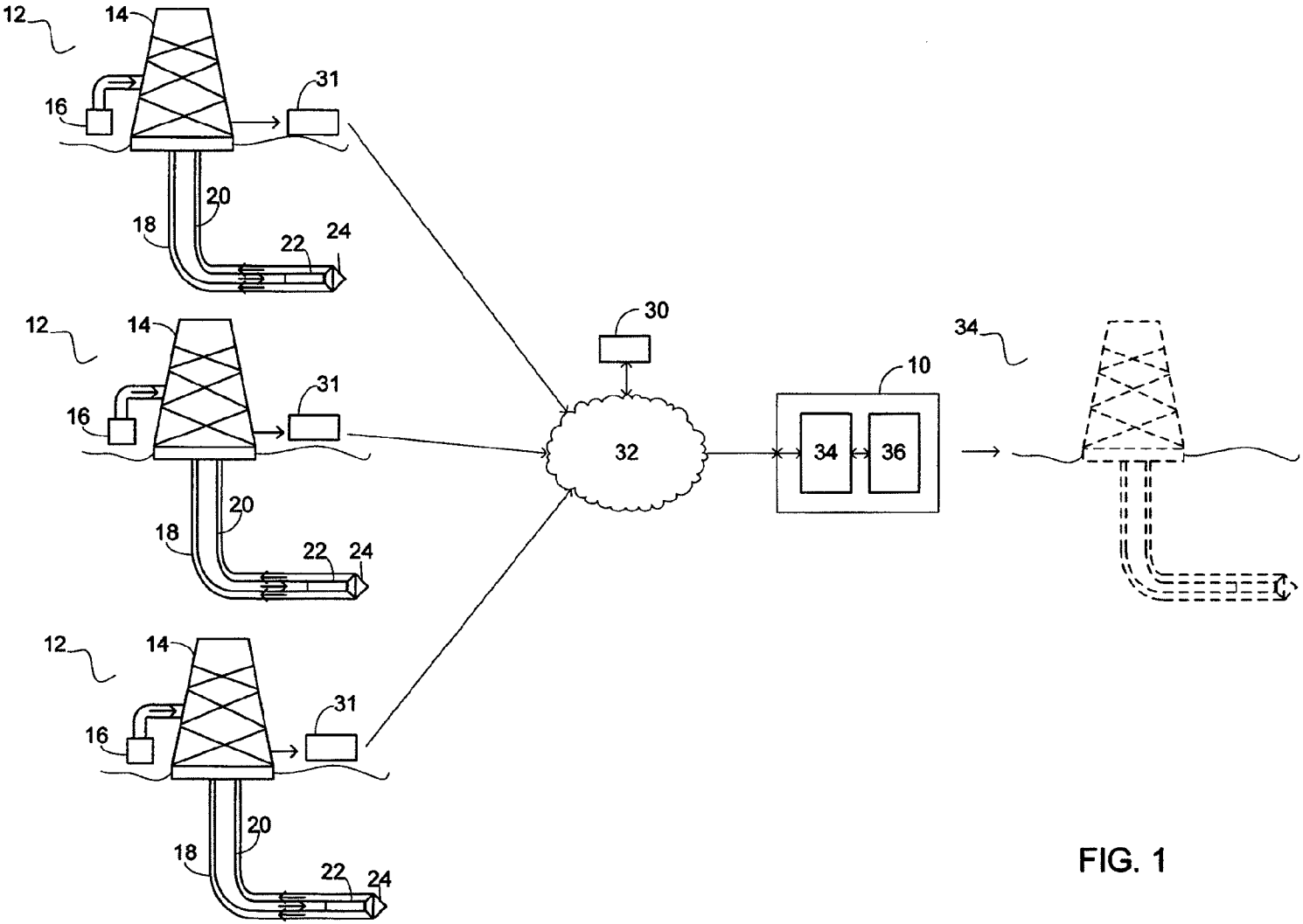
FIG. 1 is a block diagram of an apparatus configured to access and correct data points acquired during well drilling according to a first embodiment, and to utilize the corrected data points to formulate a drilling plan for a proposed well.

Data collected and recorded during the drilling of oil and gas wells can be used for multiple purposes. As depicted in FIG. 1, one such purpose is to use data recorded during the drilling of one or more existing wells 12 ("offset wells") to formulate a drilling plan for a future, proposed well 34 ("proposed well").

In FIG. 1, three wells are being drilled which, once drilling has been completed, can be used as the offset wells 12. During drilling, each of the offset wells 12 has a derrick 14 used to rotationally drive a drill string 20 that has on one of its ends a drill bit 24. Rotation of the drill bit 24 through the earth drills the well 18. On the surface is a pump 16 that pumps drilling fluid down through the drill string 20, out through the drill bit 24, and up back to the surface through the annular region between the drill string 20 and the interior surface of the well 18; the path the drilling fluid travels from the pump 16 to the surface is indicated by the arrows in FIG. 1. Optionally, located along the drill string 20 and in the path of the drilling fluid is a measurement-while-drilling ("MWD") tool 22. The MWD tool 22 measures various downhole parameters, such as the resistivity of rock surrounding the drill bit 24 and the amount of gamma radiation encountered. The MWD tool 22 transmits the measured parameters to the surface by periodically interrupting the flow of the drilling fluid, which generates pressure signals indicative of the measured parameters that are transmitted to the surface through the drilling fluid that is being pumped down the drill string 20.

At the surface is a data recording device 31 such as the Pason Electronic Drilling Recorder™ which is communicative via a network 32 with a data storage device 30 such as the Pason Datahub™. The data storage device 30 records the parameters transmitted from the MWD tool 22 and recorded by various surface sensors (not shown) via the data recording device 31. The parameters are recorded as data points in a text file. In the present embodiment the drill string 20 includes the MWD tool 22; however, in alternative embodiments the MWD tool 22 is not present. The parameters recorded by the data storage device 30 include the hole depth of the well 18; the rate of penetration of the drill bit 24; the depth of the drill bit 24; the on bottom rate of penetration of the drill bit 18 through the earth; the weight on the drill bit 18; the rotations per minute of the drill string 20 as measured at the surface; the rotary torque applied to the drill string 20 as measured at the surface; and the total pump output of the pump 16 as measured at the surface.

An excerpt from a text file containing the data points the data storage device 30 records follows in Table 1. The text file is a LAS (Log ASCII Standard) file that is generated by the Pason Datahub™.

TABLE 1

Exemplary Excerpt from a LAS File Generated by the Pason Datahub ™

| BDEP | OBR | WOB | RPM | TOR | TPO | YYMMDD | HHMMSS |
|---|---|---|---|---|---|---|---|
| 0.2 | 0 | 0 | 28 | 0 | 2.47 | 051030 | 012031 |
| 0.4 | 0.05 | 0 | 0 | 0 | 0 | 051030 | 012033 |
| 0.6 | 618.78 | 0 | 0 | 0 | 0 | 051030 | 012034 |
| 1 | 0 | 0 | 0 | 0 | 0 | 051030 | 012035 |
| 1.2 | 0 | 0 | 0 | 0 | 0 | 051030 | 012036 |
| 1.4 | 985.33 | 0 | 0 | 0 | 0 | 051030 | 012037 |
| 1.8 | 0 | 60.2 | 29 | 0 | 1.45 | 051030 | 012041 |
| 2 | 0.3 | 60.2 | 29 | 0 | 0.84 | 051030 | 012043 |
| 2.2 | 509.16 | 60.2 | 29 | 0 | 0.84 | 051030 | 012044 |
| 2.4 | 509.16 | 60.1 | 29 | 0 | 0.84 | 051030 | 012046 |
| 2.6 | 511.13 | 60.1 | 29 | 0 | 0.84 | 051030 | 012047 |
| 2.8 | 623.36 | 60.1 | 29 | 0 | 0.84 | 051030 | 012048 |
| 3 | 623.36 | 60.1 | 29 | 0 | 0.84 | 051030 | 012049 |
| 3.2 | 901.53 | 60.1 | 29 | 0 | 0.84 | 051030 | 012050 |
| 3.6 | 0 | 60 | 29 | 0 | 0.84 | 051030 | 012051 |
| 4 | 0 | 60.1 | 29 | 0 | 0.84 | 051030 | 012052 |
| 4.4 | 0 | 60 | 29 | 0 | 0.84 | 051030 | 012053 |

TABLE 1-continued

Exemplary Excerpt from a LAS File Generated by the Pason Datahub ™

| BDEP | OBR | WOB | RPM | TOR | TPO | YYMMDD | HHMMSS |
|---|---|---|---|---|---|---|---|
| 4.8 | 0 | 60 | 29 | 0 | 0.84 | 051030 | 012054 |
| 5 | 0 | 60 | 29 | 0 | 0.84 | 051030 | 012055 |
| 5.4 | 0 | 60.1 | 29 | 0 | 0.84 | 051030 | 012056 |
| 5.6 | 998.29 | 60.1 | 29 | 0 | 0.84 | 051030 | 012057 |
| 6 | 0 | 60.1 | 29 | 0 | 0.84 | 051030 | 012058 |

In the above excerpt, BDEP is the drill bit 24 depth in meters; OBR is the on bottom rate of penetration of the drill bit 24 in meters per hour, hereinafter referred to as "ROP"; WOB is the weight on the drill bit 24 in decanewtons; RPM is the rotations per minute of the drill string 20 as measured at the surface; TOR is the rotary torque applied to the drill string 20 in Newton meters; TPO is the total pump output of the pump 16 in cubic meters per minute; YYMMDD is the date on which each data point is recorded in year/month/day format; and HHMMSS is the time at which each data point is recorded in hours/minutes/seconds format.

Ideally, the data points accurately represent the data parameters that affected drilling of the well 18. However, the data points may not accurately represent the data parameters that affected well drilling for a variety of reasons; these reasons can be divided into two groups. First, the data points may be inaccurate because of an event external from one or both of the data storage device 30 and the data recording device 31. For example, the drill string 20 may break during drilling, which would result in the TOR and RPM data parameters being inaccurate since rotational force imparted to the drill string 20 at the surface cannot be transferred to the drill bit 24 if the drill string 20 is broken, and consequently the well 18 cannot be drilled until the drill string 20 is repaired. Second, the data points may be inaccurate because of artifacts one or both of the data recording device 31 and the data storage device 30 introduce during acquisition and recording of the data points. For example, the data recording device 31 may not acquire valid data points during the beginning of drilling because the data recording device 31 is undergoing initialization, notwithstanding that drilling is proceeding normally. Such inaccuracies in the data points stored by the data storage device 30 are hereinafter referred to as "data faults".

Exemplary data faults include:

- null data points ("null points"), in which there is no usable data associated with the data points sampled at a particular depth. Null data points can result when the data recording device 31 fails to obtain a reading from one of the downhole or surface sensors at the offset wells 12;
- data points sampled while the drill string is sliding ("sliding points"). Sliding refers to when the drill string 20 is not being rotated at the surface but the drill bit 24 is nonetheless being rotated by a mud motor that is hydraulically powered by drilling fluid that is pumped from the surface. In the present embodiment, due to sliding friction between the exterior of the drill string 20 and the interior of the well 18, the data recording device 31 may inaccurately measure WOB when sliding is ongoing, resulting in a data fault;
- data points that should be removed from the beginning or end of the array of data points ("truncation points"). When drilling the beginning of the well 18, the data recording device 31 may be initializing, while near the end of drilling the well 18 may be in the completion phase. In either case or in both cases, a data fault may result.

data points for which the same depths are recorded at different key values ("duplicate points"). Duplicate points may arise when, for example, when reaming a hole and the same section of the well 18 is being repeatedly drilled, resulting in the same depths being recorded at data points indexed at different key values within the data points;

points for which an unreasonable change in depth between a pair of data points sampled sequentially has occurred ("jump points"). Jump points may result from a manual change in the bottom hole depth during drilling.

points for which stoppages in drilling are detected ("problematic points");

data points for which the measured parameter lies outside of reasonable, empirically derived boundaries ("invalid points"); and data points for which averaging with surrounding data points should be performed prior to relying on them ("smoothing points").

The text file generated by the data storage device 30 is transmitted via the network 32 to an apparatus 10 for using the data points contained in the text file to optimize a drilling plan for the proposed well 34. Prior to formulating the drilling plan, the apparatus 10 identifies and corrects the data faults contained in the data points.

The embodiments described herein are directed at the use of a processor 34 contained within the apparatus 10 that is specifically configured to read the text file containing the data points that represent parameters measured during the drilling of an oil or gas well, and to correct the data faults contained in the data points. The text file can be, for example, the LAS file that is generated by the Pason Datahub™. The LAS file can be stored on a computer readable medium 36, which includes any form of disk or semiconductor based memory such as random access memory, flash memory, read only memory, hard disk drives, optical drives and optical drive media, flash drives, and any other computer readable storage media as is known to skilled persons. The processor reads the data points from the text file and translates them into a temporary data structure that the processor directly manipulates. The temporary data structure is composed of multiple arrays with each array indexed by a key value (n). In the present embodiment, the processor accesses the following arrays in the temporary data structure:

depth (DEPTH[n]), which corresponds to the BDEP entries in the LAS file;

weight on bit (WOB[n]), which corresponds to the WOB entries in the LAS file;

rotations per minute (RPM[n]), which corresponds to the RPM entries in the LAS file;

total pump output (TPO[n]), which corresponds to the TPO entries in the LAS file;

rate of penetration (ROP[n]), which corresponds to the OBR entries in the LAS file;

measured time difference at a given depth (TD[n]), which corresponds to the difference between HHMMSS entries in the LAS file at keys n and n−1; and expected (calculated) time (TC[n]), which is calculated by dividing the difference between depth entries in the LAS file at keys n and n−1 and dividing this difference in depth by the ROP[n]. Generally, expected (calculated) time refers to determining the time between depth entries indirectly through calculation involving non-time measurements instead of directly by subtracting two time measurements.

A reference to all of the values stored in DEPTH[n], WOB[n], RPM[n], TPO[n], ROP[n], TD[n] and TC[n] is hereinafter referred to as "data[n]".

Each of the above arrays in the temporary data structure except for TC and TD is directly copied from the LAS file. Expected time is calculated by dividing the difference in depth between a first location and a second, deeper location by the rate of penetration measured at the second, deeper location. Measured time difference is calculated by subtracting TD[n] from TD[n−1]. In the embodiments described herein, identical key values used to access different arrays identify data points measured at the same depth.

Following reading the temporary data structure containing the arrays of data points, the processor tags the data points to facilitate ease of analysis, identifies the data faults in the data points based in part on the tags, and then corrects the data faults by generating corrected data based on correct data points in the array, as described in further detail below. In this way, the data containing data faults as output by the data storage device 30 is transformed into data that better represents how the well 18 was drilled, which allows the apparatus 10 to create a more accurate drilling plan for the proposed well 34. The tagging, identifying and correcting procedures that the processor implements are described below.

Tagging the Data

The NULL Tag

Figure 2:
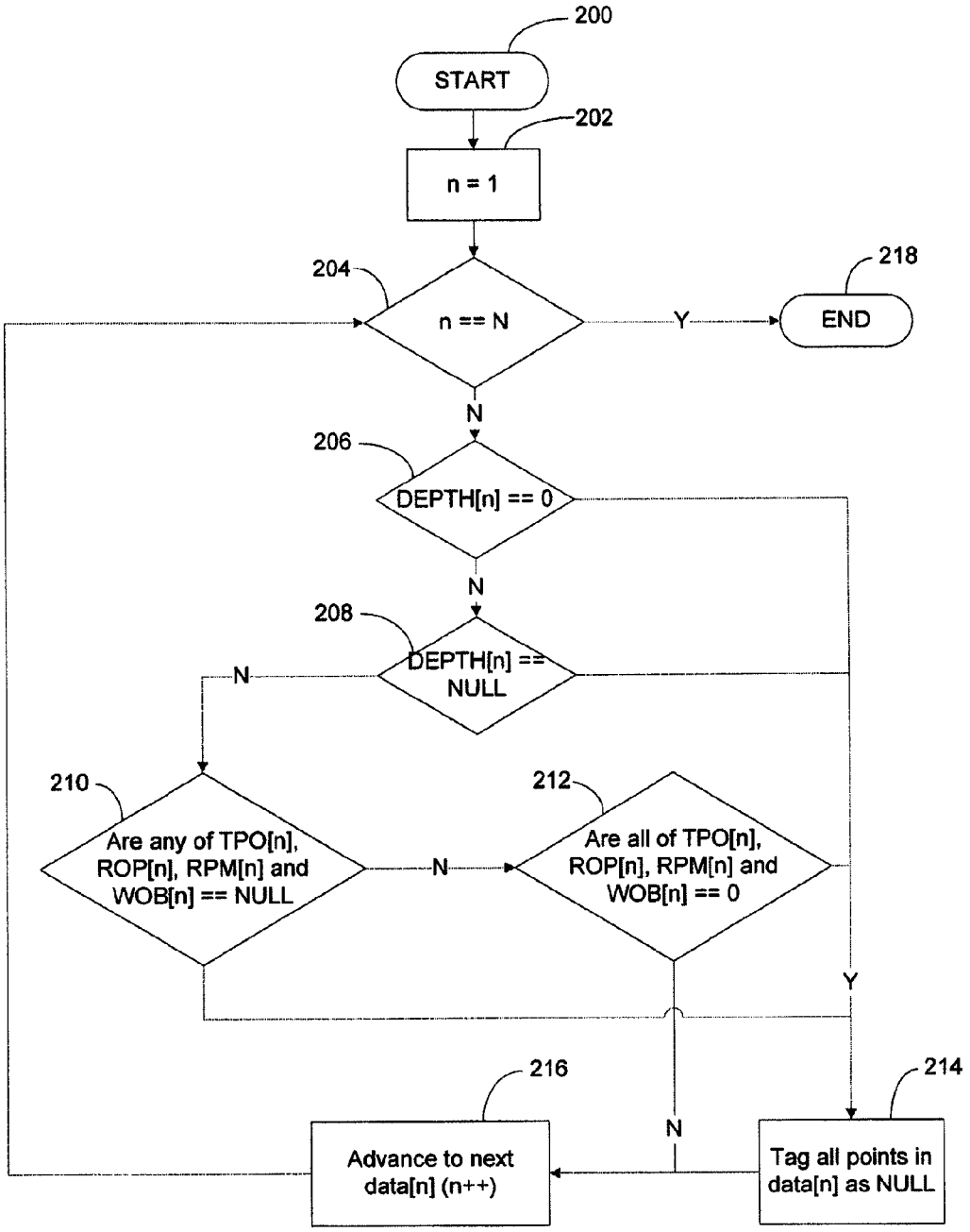
FIG. 2 is a flowchart describing a method by which NULL tags are applied to the data points.

Referring now to FIG. 2, there is depicted a flowchart that exemplifies how the processor applies the NULL tag to data[n]. The processor begins the tagging process at block 200 and immediately proceeds to data[1], which refers to all of DEPTH, WOB, RPM, TPO, ROP, TD and TC sampled together and assigned a key value of one. If data[n] has only one key value (block 204), then data[n] has an insufficient number of data points to justify correcting the data and the process terminates (block 218). If, however, data[n] contains data at multiple key values, tagging begins at block 206.

At block 206, the processor checks DEPTH[n] to determine if the recorded depth at the current key value is 0 meters, which corresponds to the surface. As the data recording device 31 of the present embodiment only begins recording when the drill bit 24 is underground, a depth of 0 meters indicates an erroneous data measurement and therefore a data fault. Consequently, if a depth of 0 meters is recorded at the given key value, out of an abundance of caution data[n] is tagged as NULL (block 214). The NULL tag is used to identify which values of data[n] should not relied upon, as described in more detail below in respect of identifying and correcting null points in data[n].

If the depth value is non-zero, then each of the DEPTH, TPO, ROP, RPM, and WOB arrays are checked at the current key value to determine whether the data recording device 31 recorded a NULL value in any of the arrays (block 210). If any of the arrays at the current key value is NULL, then out of an abundance of caution the processor tags all the arrays at the key value as NULL (block 214).

If none of the depth, TPO, ROP, RPM and WOB arrays are NULL values, then the processor checks to see if all of the recorded TPO, ROP, RPM and WOB values at the current key value are zero (block 212). Practically, the TPO, ROP, RPM and WOB values should not all be zero because this corresponds to a situation in which drilling has been suspended and the drill string is being lifted upwards, which means that the recorded data points do not correspond to the well 18 as drilled. Consequently, if all of TPO, ROB, RPM and WOB are zero at the given key value, then the processor tags all the arrays at the key value as NULL (block 214).

After the processor has decided either to tag or not tag the arrays at the given key value as NULL, the processor advances to the next key value (block 216) and returns to block 204 to repeat the process until the end of data[n] (n equals N) is reached.

Table 2, below, is an example of data that the processor has analyzed according to the method of FIG. 2.

TABLE 2

Example of Data Points in which data[n] Has Been Tagged as NULL

| DEPTH | RPM | WOB | ROP | TPO | YYMMDD | HHMMSS | TAGS |
|---|---|---|---|---|---|---|---|
| 1422.8 | 44 | 7.9 | 52 | 1.43 | 50616 | 114029 | |
| 1423 | 45 | 7.9 | 59 | 1.43 | 50616 | 114042 | |
| 0 | 0 | 0 | 0 | 0 | 50616 | 114056 | N |
| 1423.4 | 44 | 7.8 | 51.5 | 1.43 | 50616 | 114109 | |
| 1423.6 | 44 | 7.8 | 56 | 1.43 | 50616 | 114122 | |

Each row of data in Table 2 represents a different key value. As the depth value in the third row of the data in Table 2 is zero, the processor has tagged data[n] at this key value as NULL ("N").

The TD, TC, WOB, RPM, and TPO Tags

Figure 3:
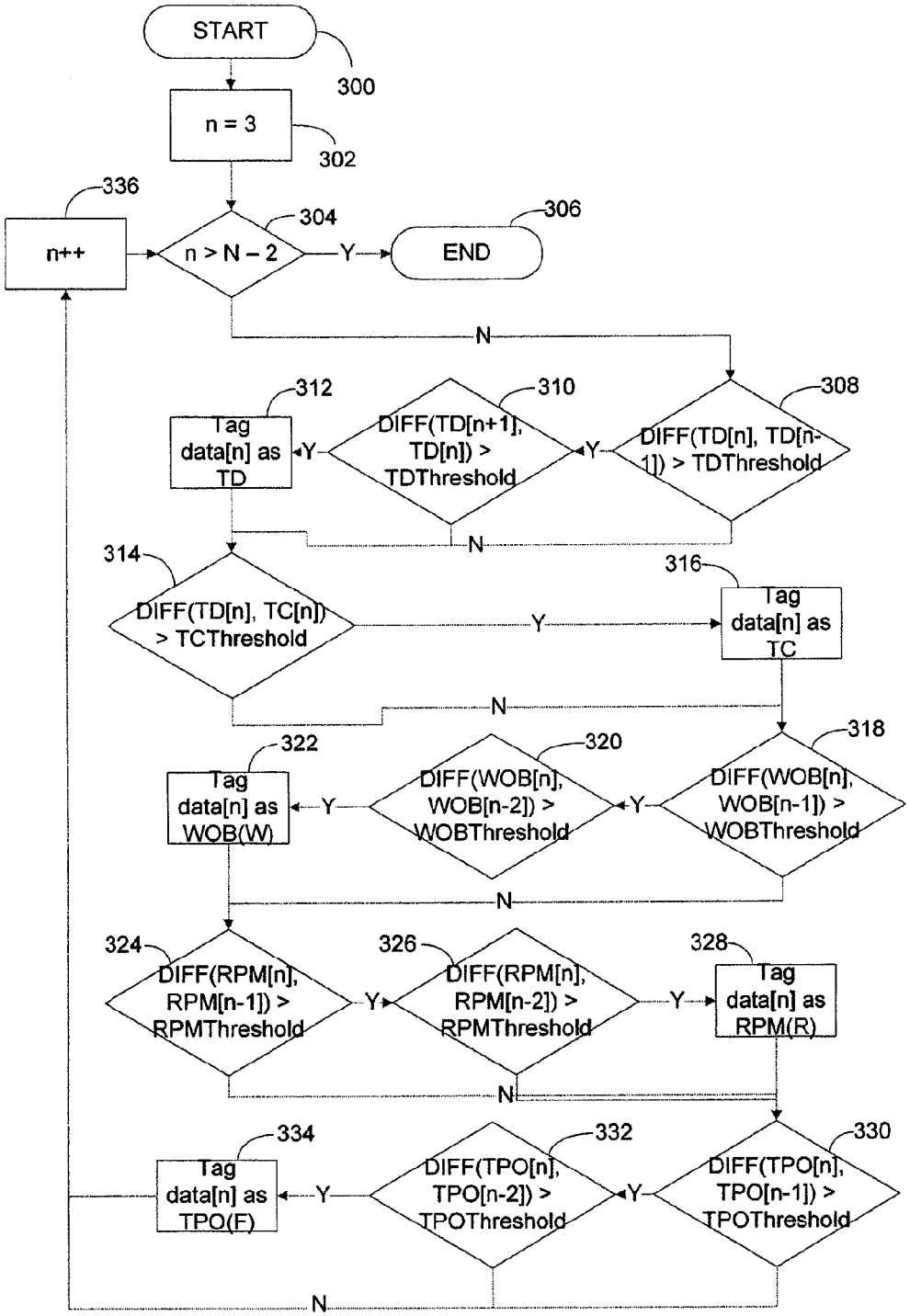
FIG. 3 is a flowchart describing a method by which TD, TC, WOB, RPM, and TPO tags are applied to the data points.

Referring now to FIG. 3, there is depicted a flowchart that exemplifies how the processor applies the TD (measured time difference), TC (calculated time difference), WOB, RPM, and TPO tags to data[n]. Multiple times in FIG. 3 the DIFF function is called. The DIFF function is defined such that DIFF(a,b)=100*((b−a)/a); in other words, DIFF(a,b) determines the percentage difference between a and b relative to a.

At block 300, the processor begins the tagging process and moves to data[3] (block 302). At block 304, the processor determines whether the current key value is at least two key values greater than the highest key value, N. If not, data[n] is insufficiently large to justify the tagging process and the method ends (block 306). If data[n] is sufficiently large to justify the tagging process, the processor proceeds to block 308.

From blocks 308 to 312 the processor determines whether the TD tag should be applied to data[n]. Presence of the TD tag means that the time the data recording device 31 recorded that it took to drill a specific segment of the well 18 was longer than an empirically derived, pre-defined measured time threshold, TDThreshold, which in the present embodiment is 100%. Recorded drill times in excess of TDThreshold are more likely to contain unreliable data than recorded drill times under TDThreshold. At blocks 308 and 310 the processor determines whether the length of time recorded to drill the segments of the well 18 immediately adjacent to the current key value exceed TDThreshold; if so, the TD tag is applied to data[n]. If not, the TD tag is not applied and the processor proceeds to block 314.

At block 314, the processor determines whether the TC tag should be applied to data[n]. Presence of the TC tag means that the time the processor calculates that drilling should have taken between depth[n] and depth[n−1] (TC[n]), based on the depth drilled divided by the rate of penetration of the drill bit 24 as measured at depth[n], is substantially different from the recorded time TD[n]. At block 314 the processor determines this by comparing DIFF(TD[n],TC[n]) to a pre-defined calculated time threshold, TCThreshold, which is typically 10%. If DIFF(TD[n],TC[n]) exceeds TCThreshold, the difference between recorded and calculated time is significant and the TC tag is applied to data[n].

The processor then proceeds to block 318 where it determines whether the WOB tag should be applied to data[n]. At blocks 318 and 320, the processor determines whether the difference between WOB measured between the current key value and the last and second to last key values, respectively, exceeds a pre-defined WOBThreshold of 10%. When these differences exceed the WOBThreshold, WOB[n] is less likely to be reliable and the processor therefore tags data[n] as WOB. The processor analogously determines whether to tag data[n] as RPM at blocks 324 through 328, and also whether to tag data[n] as TPO at blocks 330 through 332. In both of these latter cases, changes in RPM and TPO levels beyond RPMThreshold and TPOThreshold, respectively, are indicative of unreliable data. Typical values of RPMThreshold and TPOThreshold are 10% each.

Following determination of whether data[n] should be tagged as TPO, the processor proceeds to block 336 where it increments the key value by one and then returns to block 304.

Table 3, below, is an example of data that the processor has analyzed according to the method of FIG. 3.

TABLE 3

Example of Data Points in which data[n] Has Been Tagged as TC, TD, WOB, RPM, and TPO

| DEPTH | RPM | WOB | ROP | TPO | YYMMDD | HHMMSS | TAGS |
|---|---|---|---|---|---|---|---|
| 17.6 | 0 | 70 | 589 | 1.1 | 50612 | 60240 | |
| 17.8 | 0 | 70 | 645.5 | 1.08 | 50612 | 60241 | |
| 18 | 0 | 70 | 781 | 1.08 | 50612 | 60242 | |
| 18.2 | 0 | 70 | 584 | 1.08 | 50612 | 60243 | TC(19%) |
| 18.4 | 0 | 70 | 413.4 | 1.08 | 50612 | 60244 | TC(43%) |
| 18.6 | 0 | 70 | 457.2 | 1.08 | 50612 | 60246 | TC(27%) |
| 18.8 | 0 | 70 | 559.5 | 1.09 | 50612 | 60247 | TC(22%) |
| 19 | 0 | 70 | 469 | 1.09 | 50612 | 60249 | TC(30%) |
| 19.2 | 0 | 70 | 483.2 | 1.09 | 50612 | 60250 | TC(33%) |
| 19.4 | 0 | 70 | 488.1 | 1.08 | 50612 | 60252 | TC(36%) |
| 19.6 | 0 | 70 | 519.1 | 1.08 | 50612 | 60253 | TC(28%) |
| 19.8 | 0 | 70 | 349.1 | 1.08 | 50612 | 60255 | |
| 20 | 0 | 70 | 337 | 1.09 | 50612 | 60257 | |
| 20.2 | 0 | 70 | 55.4 | 1.09 | 50612 | 60310 | |
| 20.4 | 0 | 70 | 60.7 | 1.09 | 50612 | 60322 | |
| 20.6 | 0 | 70 | 164.1 | 1.09 | 50612 | 60326 | |
| 20.8 | 0 | 70 | 120.3 | 1.09 | 50612 | 60332 | |
| 21 | 0 | 70 | 260 | 1.09 | 50612 | 60335 | |
| 21.2 | 0 | 70 | 13.1 | 1.09 | 50612 | 60430 | TD(1733%) |
| 21.4 | 0 | 70 | 4.8 | 1.09 | 50612 | 60703 | TD(178%) |

TABLE 3-continued

Example of Data Points in which data[n] Has Been Tagged as TC, TD, WOB, RPM, and TPO

| DEPTH | RPM | WOB | ROP | TPO | YYMMDD | HHMMSS | TAGS |
|---|---|---|---|---|---|---|---|
| 21.6 | 500 | 70 | 2.9 | 1.09 | 50612 | 61256 | TC(42%) |
| 21.8 | 50 | 4.5 | 7.2 | 1.09 | 50612 | 61437 | WOB(94%) RPM(90%) |
| 22 | 51 | 5.5 | 20.4 | 1.09 | 50612 | 61512 | WOB(22%) |
| 22.2 | 56 | 5.9 | 14.1 | 1.09 | 50612 | 61602 | |
| 22.4 | 56 | 5.6 | 12.1 | 1.09 | 50612 | 61702 | |
| 22.6 | 61 | 5.1 | 15.1 | 1.09 | 50612 | 61750 | |
| 22.8 | 63 | 6.1 | 5.8 | 1.09 | 50612 | 61956 | |
| 23 | 58 | 5.7 | 25.6 | 1.09 | 50612 | 62023 | |
| 23.2 | 56 | 5.6 | 14.3 | 1.09 | 50612 | 62114 | |
| 23.4 | 55 | 6.2 | 53.5 | 1.09 | 50612 | 62127 | |
| 23.6 | 55 | 6.9 | 9.1 | 1.09 | 50612 | 62244 | |
| 23.8 | 56 | 5.9 | 11.2 | 1.09 | 50612 | 62349 | |
| 24 | 57 | 5.7 | 8.9 | 1.09 | 50612 | 62511 | |
| 24.2 | 56 | 5.4 | 13.3 | 1.09 | 50612 | 62606 | |
| 24.4 | 57 | 6.2 | 11 | 1.09 | 50612 | 62710 | |
| 24.6 | 76 | 5.9 | 17.7 | 1.09 | 50612 | 62751 | RPM(33%) |
| 25.4 | 111 | 5.9 | 6.5 | 1.37 | 50612 | 70748 | RPM(46%) TPO(26%) TC(441%) |

The SLIDING Tag

Figure 4:
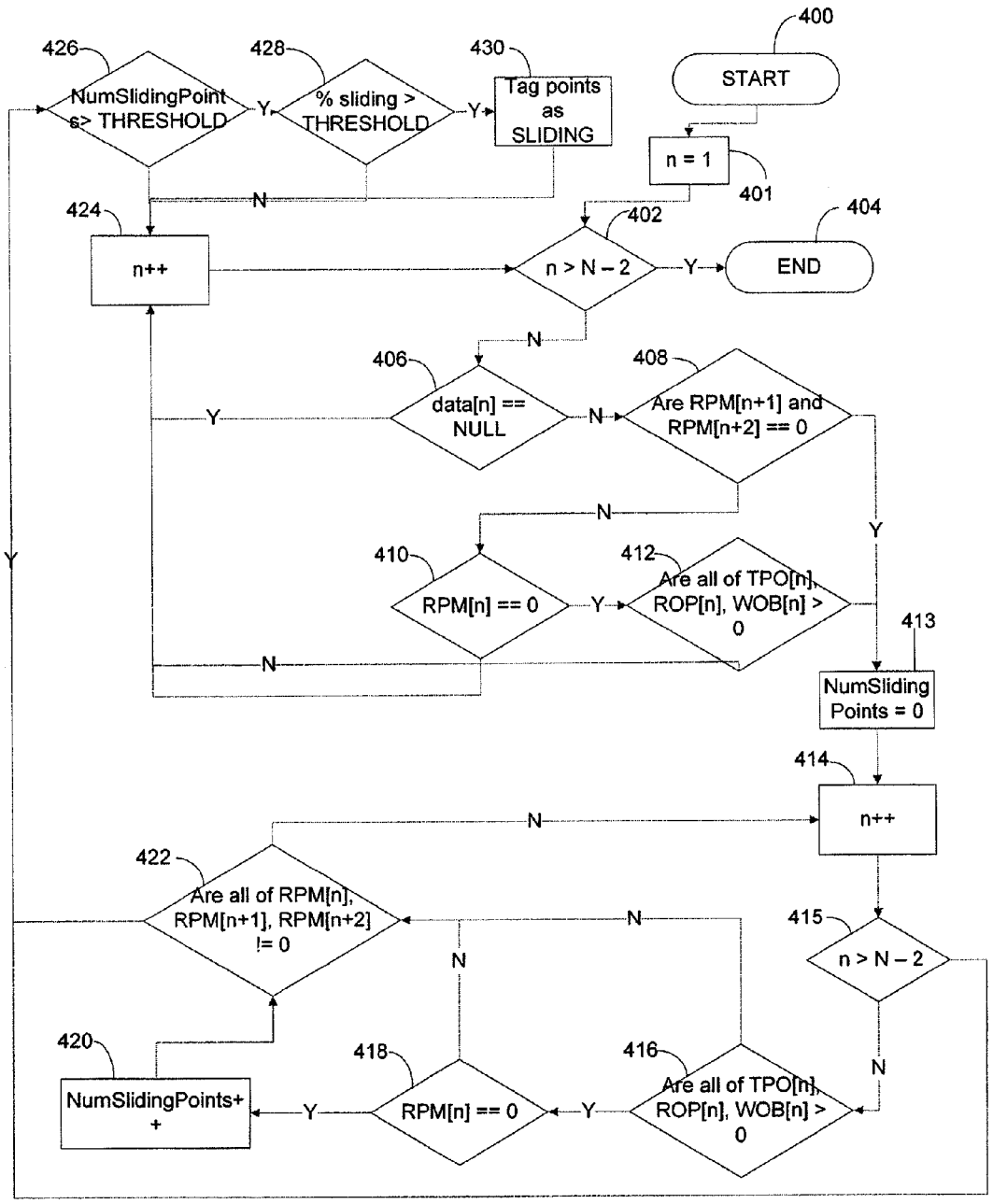
FIG. 4 is a flowchart describing a method by which SLIDING tags are applied to the data points.

Referring now to FIG. 4, there is depicted a flowchart that exemplifies how the processor applies the SLIDING tag to data[n]. At block 400, the processor begins the tagging process and proceeds to block 401 where the processor moves to the beginning of data[n] (n=1). The processor then confirms that data[n] is sufficiently large to justify the tagging process (block 402). The processor does this by ensuring that the current key value is at least two key values away from the largest key value, N. The processor does this because when determining whether any data[n] should be tagged as SLIDING, the processor utilizes data points indexed at a key value that is two greater than the current key value. If data[n] is insufficiently large, the process terminates (block 404). If data[n] is sufficiently large, identification of sliding begins at block 406.

Blocks 406, 408, 410 and 412 are used to determine the start of a group of sliding points. At block 406, the processor first determines whether data[n] at the current key value has been tagged as NULL. If so, the processor recognizes data[n] as being unusable and proceeds to the next key value at block 424. If data[n] is not tagged as NULL, the processor checks to see whether RPM values recorded for the next two key values is zero (block 408). As sliding is characterized by not rotating the drill string 20 at the surface to drill (i.e. RPM[n] is zero) but instead drilling by using drilling fluid to hydraulically rotate the drill bit 24 using a mud motor, multiple recorded RPM values being zero is indicative of sliding. Consequently, if the RPM values for the next two key values is zero, this potentially indicates the beginning of a group of sliding points and the processor proceeds to count the number of sliding points at block 413.

Alternatively, even if the RPM values recorded for the next two key values is non-zero, the processor checks to see if the RPM value at the current key value is zero and if any of TPO, ROP and WOB at the current key value are greater than zero (blocks 410 and 412). During sliding, while RPM is zero, all of TPO, ROP and WOB are greater than zero because the pump 16 pumps drilling fluid down the drill string 20 to drive the mud motor which results in the drill bit 24 penetrating through the earth. Consequently, if the processor determines that the result of blocks 410 and 412 is yes, this also potentially indicates the beginning of a group of sliding points and the processor proceeds to block 413. Block 408 is used in conjunction with blocks 410 and 412 in the event that the data recording device 31 acquires a non-zero RPM[n] reading due to signal noise, for example, notwithstanding that sliding is in fact occurring. By considering RPM[n+1] and RPM[n+2], the processor reduces the likelihood that sliding will be missed because of a mistakenly acquired non-zero RPM[n] data point.

Blocks 413 through 422 are executed to determine whether a certain subset of data[n] should be tagged as SLIDING. The subset of data[n] begins when either of blocks 408 or 412 is satisfied, and ends when block 422 is satisfied. Specifically, the number of data[n] points in the subset that satisfy the criteria specified in blocks 416 and 418 are classified as sliding points and a count of the number of sliding points is maintained in the NumSlidingPoints variable. If, after considering the subset of data[n], both a sufficient number of sliding points have been counted and the number of sliding points constitutes a sufficient percentage of the examined subset of data[n], all the data[n] values in the subset are tagged as SLIDING.

At block 413, the variable NumSlidingPoints is reset to zero. At block 414, the key value is incremented by one and the processor then proceeds to determine whether data[n] is sufficiently large to continue to justify the tagging process (block 415) and how many of the data points in the subset of data[n] can potentially be tagged as sliding points. At blocks 416 and 418, the processor determines if TPO, ROP and WOB at the current key value are all greater than zero and if RPM at the current key value is equal to zero, which as explained above in respect of blocks 410 and 412 is indicative of sliding. If yes, the processor increments NumSlidingPoints by one (block 420); if no, NumSlidingPoints is not incremented. After the processor increments NumSlidingPoints or determines that NumSlidingPoints does not have to be incremented, it determines whether the RPM readings for the current key value and for the next two key values are all not equal to zero. If the RPM readings for the current and next two key values are zero, then this is indicative of sliding continuing and the processor returns to block 414. If the RPM readings for the current and next two key values are all non-zero, then this is indicative of the drill string 20 being rotated from the surface, and the processor consequently determines that sliding has ended and proceeds to block 426.

At block 426, the processor determines whether the number of sliding points recorded in NumSlidingPoints is greater than a pre-specified threshold, and at block 428 the processor determines whether the number of sliding points makes up at least a certain percentage of the subset of data[n] considered at blocks 414 through 422. In the present embodiment, the threshold for block 426 is four points, and the threshold for block 428 is 70%. If both of these thresholds are met, the processor tags all the points in the subset of data[n] that was considered at blocks 414 through 422 as SLIDING (block 430), increments the key value by one (block 424), and returns block 402.

Table 4, below, is an example of a portion of data[n] that has been analyzed according to the method of FIG. 4.

TABLE 4

Example of Data Points in which data[n] Has Been Tagged as SLIDING

| DEPTH | RPM | WOB | ROP | TPO | YYMMDD | HHMMSS | |
|---|---|---|---|---|---|---|---|
| 16.6 | 56 | 5.9 | 14.1 | 1.09 | 50612 | 60200 | |
| 16.8 | 56 | 5.6 | 12.1 | 1.09 | 50612 | 60205 | |
| 17 | 61 | 5.1 | 15.1 | 1.09 | 50612 | 60210 | |
| 17.2 | 63 | 6.1 | 5.8 | 1.09 | 50612 | 60215 | |
| 17.4 | 58 | 5.7 | 25.6 | 1.09 | 50612 | 60220 | |
| 17.6 | 0 | 70 | 589 | 1.1 | 50612 | 60240 | S |
| 17.8 | 0 | 70 | 645.5 | 1.08 | 50612 | 60241 | S |
| 18 | 0 | 70 | 781 | 1.08 | 50612 | 60242 | S |
| 18.2 | 0 | 70 | 584 | 1.08 | 50612 | 60243 | S |
| 18.4 | 0 | 70 | 413.4 | 1.08 | 50612 | 60244 | S |
| 18.6 | 0 | 70 | 457.2 | 1.08 | 50612 | 60246 | S |
| 18.8 | 0 | 70 | 559.5 | 1.09 | 50612 | 60247 | S |
| 19 | 0 | 70 | 469 | 1.09 | 50612 | 60249 | S |
| 19.2 | 0 | 70 | 483.2 | 1.09 | 50612 | 60250 | S |
| 19.4 | 0 | 70 | 488.1 | 1.08 | 50612 | 60252 | S |
| 19.6 | 0 | 70 | 519.1 | 1.08 | 50612 | 60253 | S |
| 19.8 | 0 | 70 | 349.1 | 1.08 | 50612 | 60255 | S |
| 20 | 0 | 70 | 337 | 1.09 | 50612 | 60257 | S |
| 20.2 | 0 | 70 | 55.4 | 1.09 | 50612 | 60310 | S |
| 20.4 | 0 | 70 | 60.7 | 1.09 | 50612 | 60322 | S |
| 20.6 | 0 | 70 | 164.1 | 1.09 | 50612 | 60326 | S |
| 20.8 | 0 | 70 | 120.3 | 1.09 | 50612 | 60332 | S |
| 21 | 0 | 70 | 260 | 1.09 | 50612 | 60335 | S |
| 21.2 | 0 | 70 | 13.1 | 1.09 | 50612 | 60430 | S |
| 21.4 | 0 | 70 | 4.8 | 1.09 | 50612 | 60703 | S |
| 21.6 | 500 | 70 | 2.9 | 1.09 | 50612 | 61256 | |
| 21.8 | 50 | 4.5 | 7.2 | 1.09 | 50612 | 61437 | |
| 22 | 51 | 5.5 | 20.4 | 1.09 | 50612 | 61512 | |
| 22.2 | 56 | 5.9 | 14.1 | 1.09 | 50612 | 61602 | |
| 22.4 | 56 | 5.6 | 12.1 | 1.09 | 50612 | 61702 | |
| 22.6 | 61 | 5.1 | 15.1 | 1.09 | 50612 | 61750 | |
| 22.8 | 63 | 6.1 | 5.8 | 1.09 | 50612 | 61956 | |

The data points tagged as SLIDING in Table 4 (labelled with a "S") are those in which RPM is zero but WOB, ROP and TPO are not.

The JUMP Tag

Figure 7:
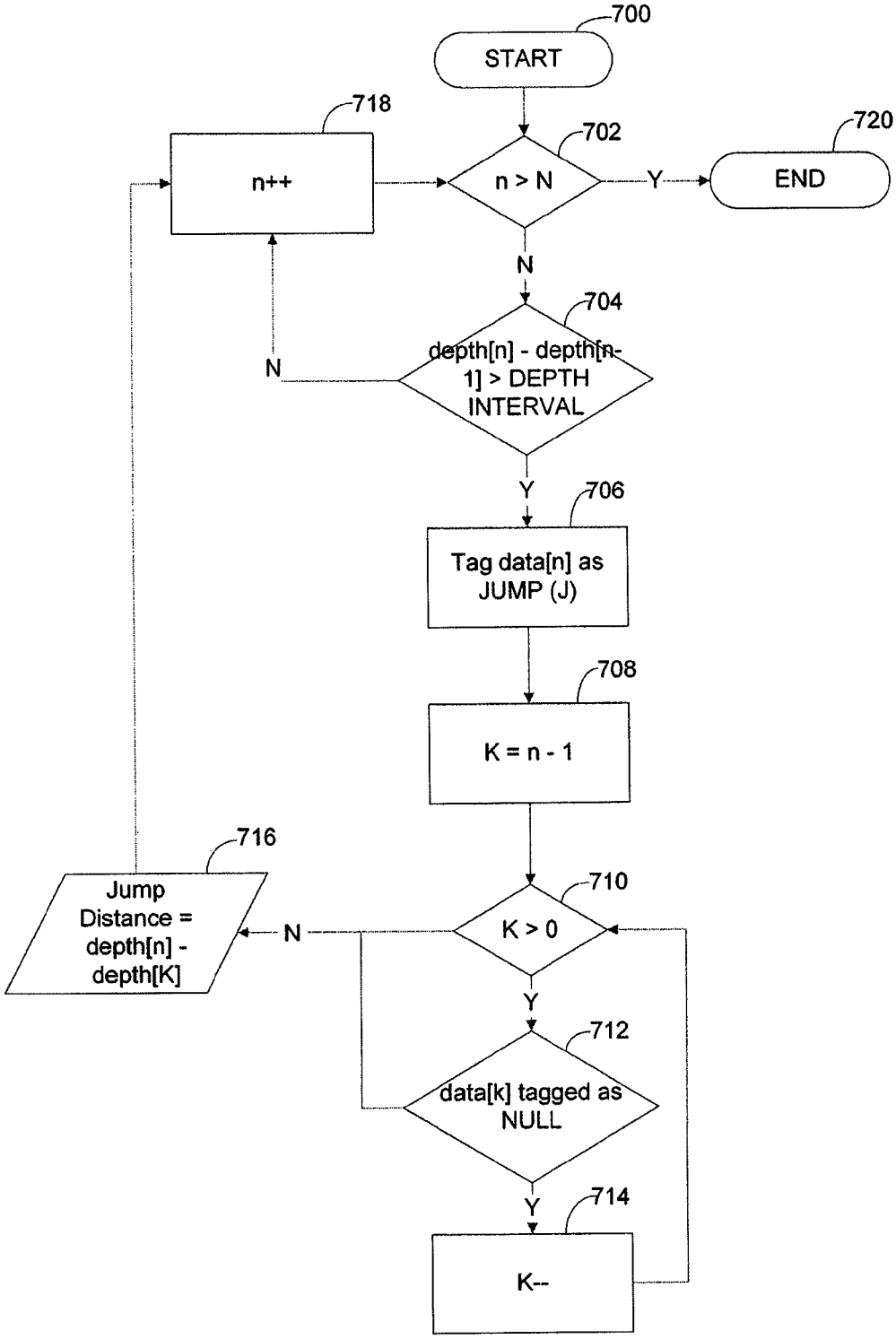
FIG. 7 is a flowchart describing a method by which JUMP tags are applied to the data points.

Referring now to FIG. 7, there is depicted a flowchart describing how the processor applies the JUMP tag to data[n]. The processor begins at block 700 and at block 702 determines whether the current key value is greater than the highest key value; if so, no points in data[n] remain to be analyzed and the processor proceeds to block 720 and the method ends. If not, the processor proceeds to block 704 and calculates the difference between the depth recorded at the current key value and the depth recorded at the previous key value. This difference in depths is compared to a pre-determined depth interval, which in the present embodiment is 0.2 meters (the resolution of the depth recordings generated by the data recording device 31) but may vary in alternative embodiments. Empirically, it has been determined that changes in depths recorded at two sequentially recorded key values in excess of the depth interval are unlikely, and therefore probably correspond to erroneous data. If the difference in depths calculated at block 704 is less than the depth interval, the processor does not further analyze the depth recorded at the current key value, proceeds to increment the key value by one at block 718 and returns to block 702. If, however, the difference in depths exceeds the depth interval, the processor applies the JUMP tag to data[n] (block 706) and then proceeds to determine the "jump distance" at blocks 708 through 716.

The "jump distance" is the distance between depth[n] and the first depth data point that precedes depth[n] that is not tagged as NULL (depth[K]). To determine depth[K], the processor first assigns K to be the key value immediately prior to the current key value (block 708). After confirming that K is greater than zero (block 710), the processor checks to see whether data[K] has been tagged as NULL (block 712). If so, K is decreased by one (block 714) and the processor iteratively reduces K until it finds the first value of data[K] that is not tagged as NULL. If the processor determines at block 712 that data[K] is not tagged as NULL, it executes block 716 where the jump distance is determined as the difference between depth[n] and depth[K]. The processor then increments the key value by one at block 718 and returns to block 702. The jump distance forms part of the JUMP tag.

Table 5, below, illustrates how the processor applies the JUMP tag to data[n].

TABLE 5

Example of Data Points in which data[n] Has Been Tagged as JUMP

| DEPTH | RPM | WOB | ROP | TPO | YYMMDD | HHMMSS | |
|---|---|---|---|---|---|---|---|
| 24.4 | 57 | 6.2 | 11 | 1.09 | 50612 | 62710 | |
| 24.6 | 76 | 5.9 | 17.7 | 1.09 | 50612 | 62751 | |
| 25.4 | 111 | 5.9 | 6.5 | 1.37 | 50612 | 70748 | J(0.8 m) |
| 25.6 | 103 | 2.5 | 17.7 | 1.36 | 50612 | 70829 | |
| 25.8 | 110 | 3.5 | 9.7 | 1.36 | 50612 | 70941 | |

In Table 5, the pre-determined depth interval is 0.2 meters. Consequently, data[n] that has a depth of 25.4 meters is tagged as a jump point, and the jump distance is determined to be 0.8 meters.

The DUPLICATE Tag

Figure 6:
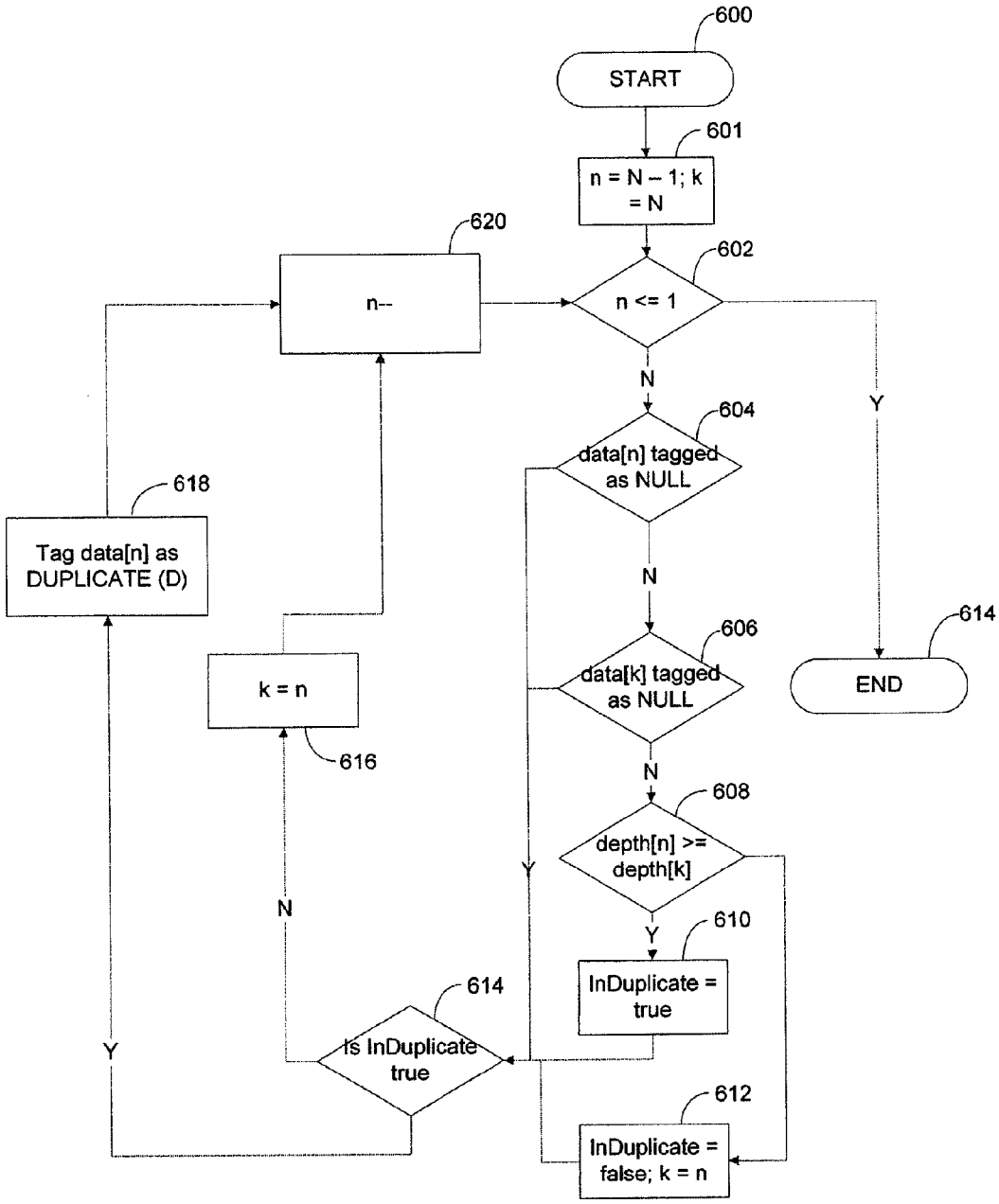
FIG. 6 is a flowchart describing a method by which DUPLICATE tags are applied to the data points.

Referring now to FIG. 6, there is depicted a flowchart that exemplifies how the processor applies the DUPLICATE tag to data[n]. The processor begins at the second to last key value of data[n] (n equals N−1) and checks for duplicate points while decreasing the key value until it equals 1, which is the beginning of data[n]; this is indicated in blocks 600 and 602. A variable k is also created, whose function is described in greater detail below.

Blocks 604 to 614 are used to determine whether to tag data[n] as DUPLICATE. An InDuplicate flag is referred to in blocks 610, 612, and 614; when InDuplicate is true, the current key value corresponds to a key value of a point that is duplicated in data[n]. In blocks 604 and 606, the processor determines whether either of data[n] and data[k] are tagged as NULL; if so, the depths of data[n] and data[k] cannot be compared, and the processor skips blocks 608 and 610 and proceeds directly to block 614. If data[n] and data[k] are not tagged as NULL, depth[n] is compared to depth[k] to determine whether depth[n] is greater than or equal to depth[k] (block 608). As k>n, depth[k] should always be greater than depth[n] as drilling increases depth. If depth[n]>depth[k], this is indicative of a section of data points that duplicated within data[n]. Consequently, the InDuplicate flag is set to true (block 610), and the processor tags data[n] as being DUPLICATE in block 618. Subsequently, the key value is decreased by one and the processor returns to block 602.

Eventually, the key value will be decreased such that data[n] is no longer duplicated. When this occurs, depth[n] is no longer greater than or equal to depth[k], so the processor will proceed to block 612 from block 608 instead of to block 610. At block 612 the processor sets InDuplicate to false and resets k to equal n such that the processor is ready to tag the next set of duplicate points it may encounter in data[n] as it continues to decrease the key value.

Table 6, below, illustrates how the processor tags data points as DUPLICATE.

TABLE 6

Example of Data Points in which data[n] Has Been Tagged as DUPLICATE

| DEPTH | RPM | WOB | ROP | TPO | YYMMDD | HHMMSS | TAGS |
|---|---|---|---|---|---|---|---|
| 2021 | 21 | 17.5 | 4.3 | 1.36 | 50618 | 71610 | |
| 2021.2 | 21 | 17.4 | 4.1 | 1.36 | 50618 | 71908 | |
| 2021.4 | 21 | 17.3 | 4.5 | 1.36 | 50618 | 72151 | D(1.2 m) |
| 2021.6 | 21 | 17.2 | 4.9 | 1.36 | 50618 | 72420 | D(1.2 m) |
| 2021.8 | 22 | 17.2 | 4.4 | 1.36 | 50618 | 72701 | D(1.2 m) |
| 2022 | 21 | 17.4 | 4.6 | 1.36 | 50618 | 72938 | D(1.2 m) |
| 2022.2 | 22 | 17.1 | 4.9 | 1.36 | 50618 | 73206 | D(1.2 m) |
| 2022.4 | 22 | 17.1 | 4.4 | 1.36 | 50618 | 73447 | D(1.2 m) |
| 2022.6 | 22 | 16.8 | 5 | 1.36 | 50618 | 73713 | D(1.2 m) |
| 2021.4 | 22 | 16.9 | 0 | 1.36 | 50618 | 73845 | |
| 2021.6 | 71 | 27.7 | 13.2 | 1.57 | 50618 | 164808 | |
| 2021.8 | 27 | 7 | 18 | 1.42 | 50618 | 164848 | |
| 2022 | 32 | 7.5 | 16.3 | 1.43 | 50618 | 164933 | |
| 2022.2 | 30 | 7.5 | 16.2 | 1.43 | 50618 | 165018 | |
| 2022.4 | 34 | 7.6 | 15.9 | 1.42 | 50618 | 165102 | |
| 2022.6 | 30 | 8 | 17.4 | 1.42 | 50618 | 165144 | |
| 2022.8 | 30 | 9.9 | 24.4 | 1.43 | 50618 | 165213 | |
| 2023 | 29 | 9.8 | 17.8 | 1.43 | 50618 | 165253 | |

In Table 6, the depth range of 2021.4 m to 2022.6 m is repeated, and the repeated depths with the lower key value in data[n] are tagged as DUPLICATE. The depth over which duplication occurs is 1.2 meters, which is calculated at block 610 and forms part of the DUPLICATE tag.

The INVALID Tag

Figure 9:
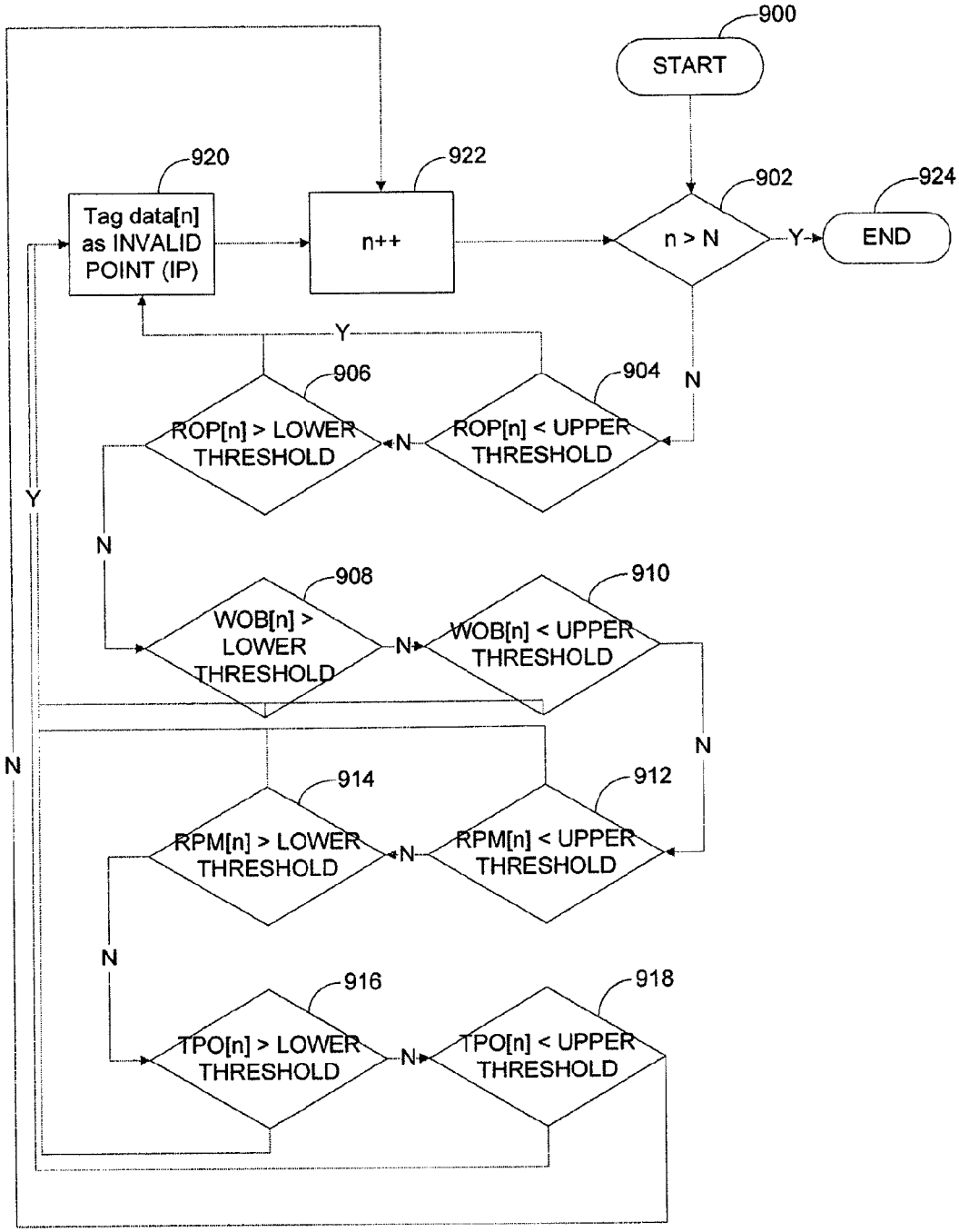
FIG. 9 is a flowchart describing a method by which INVALID tags are applied to the data points.

Referring now to FIG. 9, there is depicted a method executed by the processor to determine whether to apply the INVALID tag to data[n]. At block 900, the processor begins executing the method and proceeds to block 902 to determine whether the current key value is less than the highest key value. If not, then no further points in data[n] remain to be considered, the processor proceeds to block 924 and the method ends. If the current key value is less than the highest key value, the processor then proceeds to ensure that the rate of penetration for the current key value is within pre-determined thresholds (blocks 904 and 906), that the weight on bit for the current key value is within pre-determined thresholds (blocks 908 and 910), that the rotations per minute for the current key value is within pre-determined thresholds (blocks 912 and 914), and that the total pump output for the current key value is within pre-determined thresholds (blocks 916 and 918). The pre-determined thresholds are empirically determined such that parameters outside these thresholds are unlikely to be usable. Typically, rate of penetration measurements outside of the range of 0.1 and 750 meters/hour, weight on bit measurements outside of the range of 1 and 70 kiloDecaNewtons, rotations per minute measurements outside of the range of 0 to 350 rotations per minute, and total pump output measurements outside of the range of 0.5 and 4 cubic meters/minute are considered unusable data. Alternatively, for each of the rate of penetration, weight on bit, rotations per minute and total pump output measurements, the processor can use the $0.5^{th}$ percentile as a lower bound and the $98^{th}$ percentile as an upper bound, so long as these percentiles are within the hard limits recited above.

If the processor determines that any of the rate of penetration, the weight on bit, the rotations per minute, and the total pump output at the current key value are outside their respective pre-determined thresholds, then the processor tags data[n] as INVALID (block 920) prior to incrementing the key value at block 922 and returning to block 902. If all of the rate of penetration, the weight on bit, the rotations per minute, and the total pump output at the current key value are within their respective pre-determined thresholds, then the processor does not tag data[n] as INVALID, and proceeds directly to block 922 to increment the current key value prior to returning to block 902.

Table 7, below, illustrates how the processor applies the INVALID tag to data[n].

| DEPTH | RPM | WOB | ROP | TPO | YYMMDD | HHMMSS | |
|---|---|---|---|---|---|---|---|
| 24.2 | 56 | 5.4 | 13.3 | 0.01 | 50612 | 62606 | IP |
| 24.4 | 57 | 6.2 | 11 | 0.01 | 50612 | 62710 | IP |
| 24.6 | 76 | 5.9 | 17.7 | 0.01 | 50612 | 62751 | IP |
| 25.4 | 111 | 5.9 | 6.5 | 1.37 | 50612 | 70748 | |
| 25.6 | 103 | 2.5 | 17.7 | 1.36 | 50612 | 70829 | |
| 25.8 | 110 | 3.5 | 9.7 | 1.36 | 50612 | 70941 | |

The points of data[n] tagged as INVALID ("IP") are those for which TPO is below the pre-determined threshold.

Identifying and Correcting the Data Faults

Following tagging of data[n], the processor proceeds to identify and correct the data faults in data[n] using, for some of the data faults, the tags. In several cases in the present embodiment, tagging data in a certain way is tantamount to identifying a data fault with that data. For example, in the present embodiment tagging data[n] as NULL is tantamount to identifying data[n] as being a null point as the processor does not employ additional logic aside from checking for the existence of the NULL tag when identifying a null data point. However, for some other data faults such as duplicate points, the processor executes a significant number of instructions prior to identifying data points that have been tagged as DUPLICATE as, in fact, being duplicate points.

Correcting data faults refers to processing the data points of data[n] affected by the data faults such that after the data faults have been corrected, the data points of data[n] are better representative of the well 18 as drilled prior to correction of the data faults. For example, when dealing with null points, deletion of the null points from data[n] results in data[n] not being contaminated with unusable null data.

Truncation Points

Figure 5A:
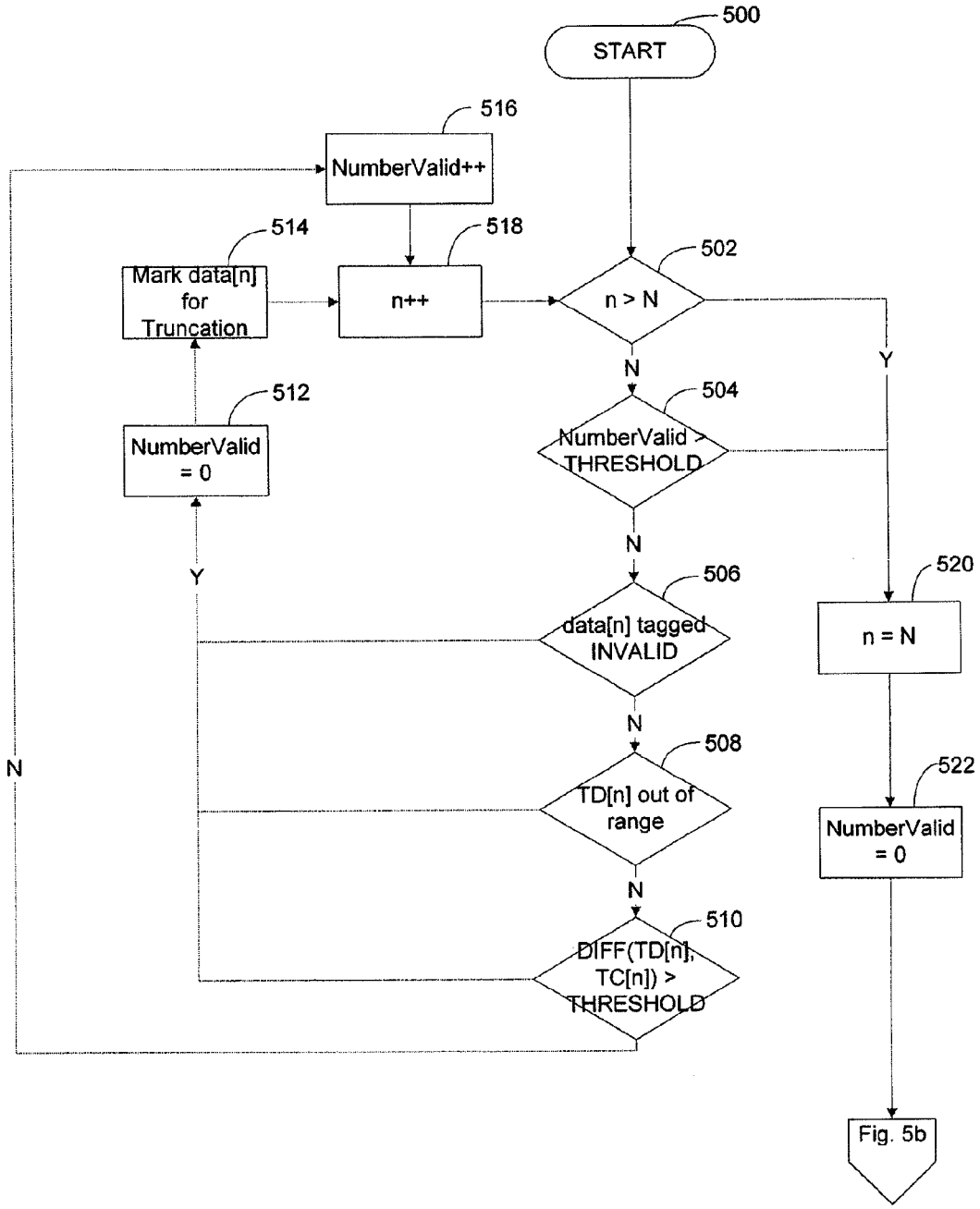
FIGS. 5*a* and 5*b* are flowcharts describing a method by which data points that should be truncated from the beginning and end of the data points are identified and deleted.
Figure 5B:
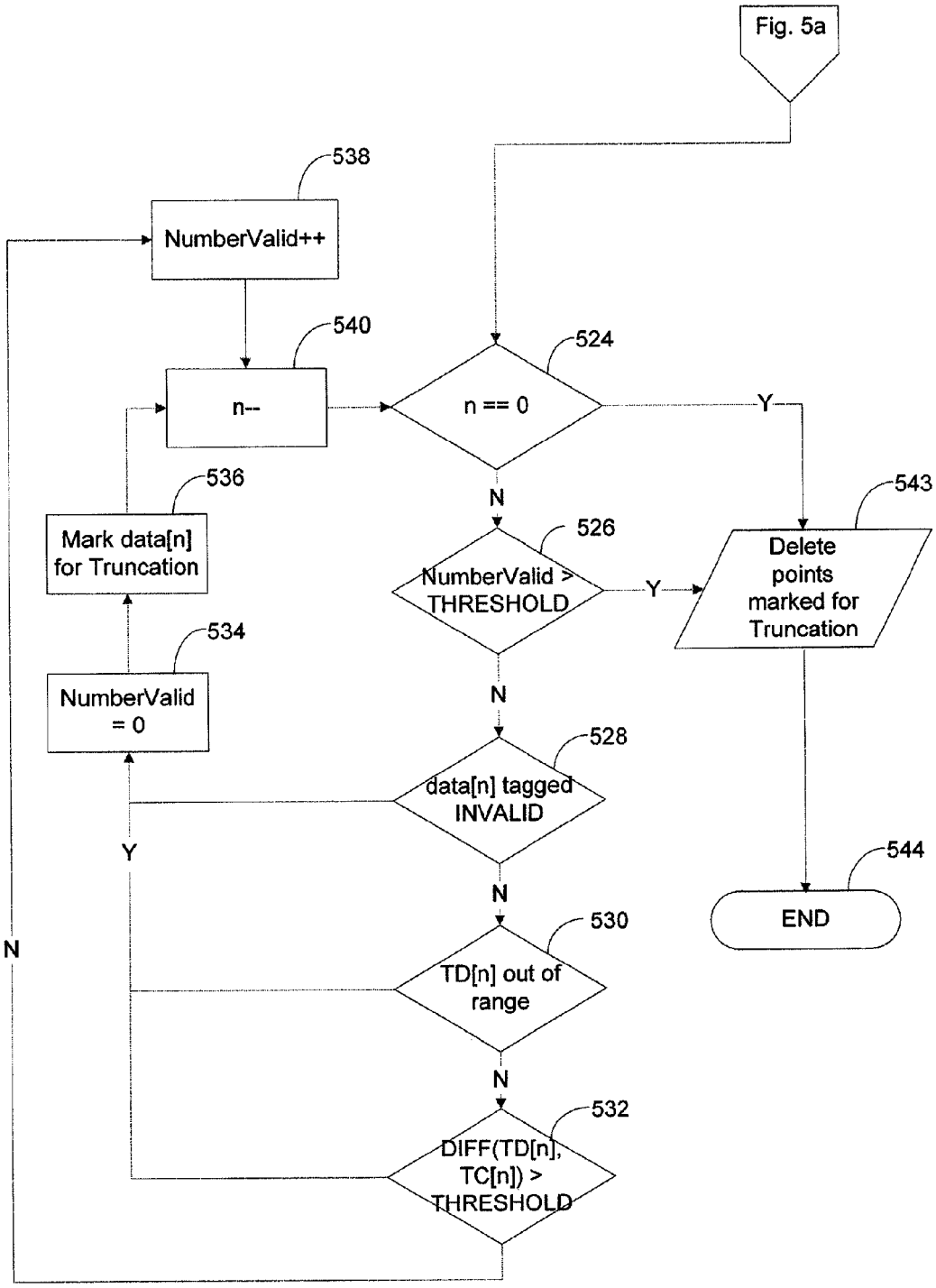

Referring now to FIGS. 5*a* and 5*b*, there is depicted a flowchart that exemplifies how the processor identifies truncation points in data[n]. Near the beginning and end of drilling, the data recording device 31 may output data that is not usable because the data recording device 31 is being initialized, for example. FIG. 5*a* depicts a method for identifying data points that are recorded at the beginning of drilling as truncation points, while FIG. 5*b* depicts a method for identifying data points that are recorded at the end of drilling as truncation points.

Referring now to FIG. 5*a*, the processor begins identification of truncation points at block 500. At block 502, the processor determines if the current key value is greater than the highest key value; if so, no more points are at the beginning of data[n] to analyze, and the processor proceeds to block 520 to analyze the data points at the end of data[n]. At block 504, the processor compares the NumberValid variable to a pre-determined threshold, which in the present embodiment is ten valid data points. In FIG. 5*a*, NumberValid refers to the number of contiguous valid, or usable, data points that the processor has counted at the beginning of data[n]. Blocks 506, 508 and 510 identify what the processor considers a usable data point. At block 506, the processor determines whether the current data point has been tagged as INVALID. At block 508, the processor determines whether TD[n] is greater than a pre-determined measured time threshold, which in the present embodiment is 100%. TD[n] being greater than the pre-determined measured time threshold is indicative of unreliable data, as empirically it is unlikely that drilling from key values n−1 to n takes longer than the pre-determined threshold. At block 510, the processor determines whether the difference between TD[n] and TC[n] is greater than an empirically pre-determined difference threshold, which in the present embodiment is 10%. A difference between TD[n] and TC[n] in excess of this threshold is indicative of a suspiciously high or low ROP, as TC is inversely proportional to ROP, and is not indicative of reliable data.

If the processor determines that any of blocks 506, 508 and 510 are satisfied, then NumberValid is reset to zero (block 512), data[n] is marked as being a truncation point (block 514), the key value is incremented by one (block 518) and the method returns to block 502. However, if the processor determines that none of blocks 506, 508 and 510 are satisfied, then the processor determines that data[n] is not a truncation point and increments NumberValid by one at block 516 prior to incrementing the key value by one at block 518 and returning to block 502. When a sufficient series of valid data points is found as indicated by a value for NumberValid that exceeds the threshold specified in block 504, the processor moves to the last key value in data[n] at block 520, resets NumberValid to zero at block 522, and proceeds to FIG. 5*b* where the truncation points recorded during the end of drilling are identified.

The method depicted in FIG. 5*b* is analogous to the method depicted in FIG. 5*a*. At block 524, the processor checks to see if the key value has been decreased to zero; if so, no further data points at the end of data[n] remain to be analyzed. If not, the processor proceeds to execute blocks 526 through to 540, which are analogous to blocks 506 to 518 of FIG. 5*a* with the exception that the key value is decreased by one at block 540 because FIG. 5*b* begins at the last key value and proceeds backwards through data[n] when identifying truncation points. When the beginning of the data array is reached (n equals zero at block 524) or a sufficient value of valid data points is found (block 526), identification of the truncation points ends, and the processor proceeds to block 543 to correct the truncation points.

In the present embodiment, correction of the truncation points simply involves deleting the truncation points from data[n], which removes the potentially corrupt data from data[n]. In alternative embodiments different algorithms can be used for correction; for example, the truncation points can be analyzed so as to determine whether any data contained therein is salvageable, and if so the data can be salvaged and be allowed to remain in data[n].

Problematic Points

Figure 8:
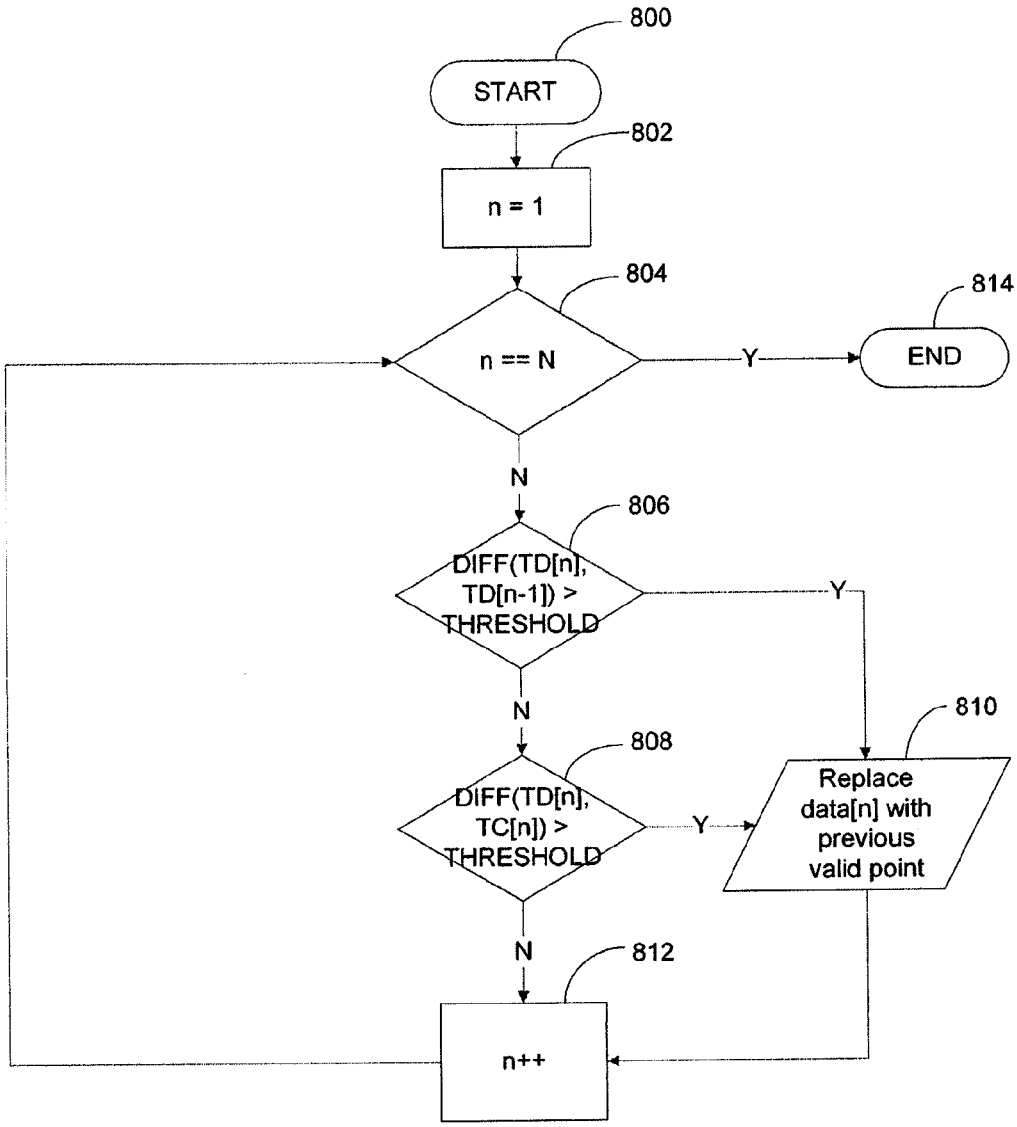
FIG. 8 is a flowchart describing a method by which problematic data points are identified and corrected in the data points.

Referring now to FIG. 8, there is depicted a flowchart describing how the processor identifies and corrects problematic points in data[n]. The processor begins at block 800 and immediately proceeds to the first key value at block 802. The processor checks whether the current key value is equal to the last key value at block 804; if so, no further data points are available to check and the processor ceases identifying and correcting problematic points. If the current key value is less than the last key value, the processor determines whether the difference between the time measured at the current key value and the time measured at the previous key value exceeds a pre-determined threshold of thirty seconds (block 806). If so, this is indicative of drilling having stopped and data[n] is unlikely to be reliable. If the difference in times calculated at block 806 does not exceed the pre-determined threshold, then the processor proceeds to block 808 and determines whether the difference between the time measured at the current key value and the time calculated for the current key value based on the difference of depth[n] and depth[n−1] divided by the rate of penetration at the current key value exceeds a pre-determined threshold of thirty seconds. If so, this is also indicative of drilling having stopped, and the data is not considered usable. Consequently, at block 810, the processor replaces data[n] with the most recently valid data. The most recently valid data is the first data in the key value that precedes the current key value that is not tagged as NULL, INVALID, and SLIDING.

Duplicate Points

As shown above in Table 6, points in data[n] that are tagged as DUPLICATE include depth values that are repeated at two different key values. In Table 4, for example, the depth values of 2021.4 m, 2021.6 m, 2021.8 m, 2022 m, 2022.2 m, 2022.4 m, and 2022.6 m are repeated at two different key values each. The first time this range of depth values appears in data[n] is hereinafter referred to as the "first leg" of duplicate values; the second time this range of depth values appears in data[n] is hereinafter referred to as the "second leg" of duplicate values. The first leg of duplicate values has lower key values than the second leg of duplicate values.

Figure 10A:
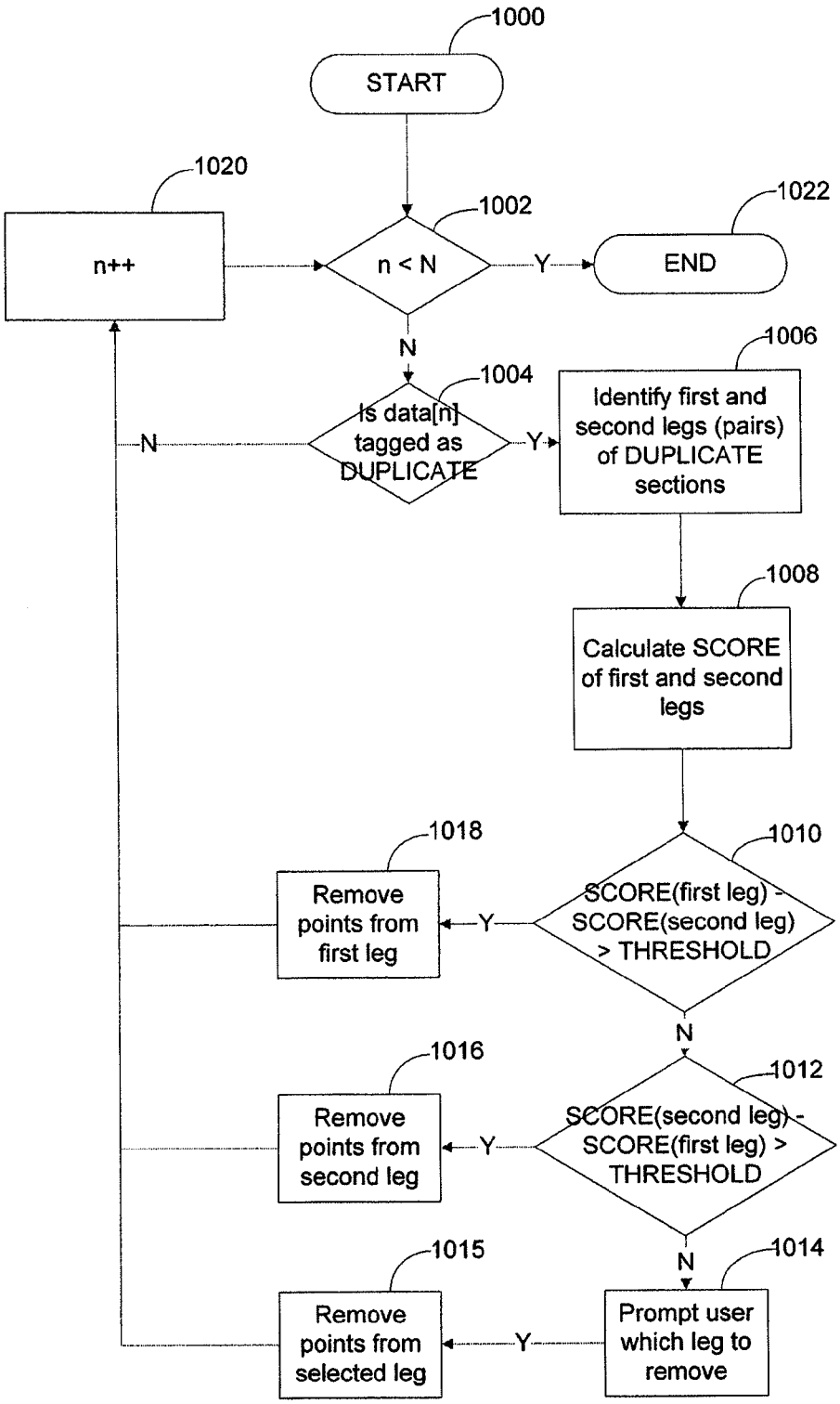
FIGS. 10*a* and 10*b* are flowcharts describing a method by which duplicate data points are identified and corrected in the data points.
Figure 10B:
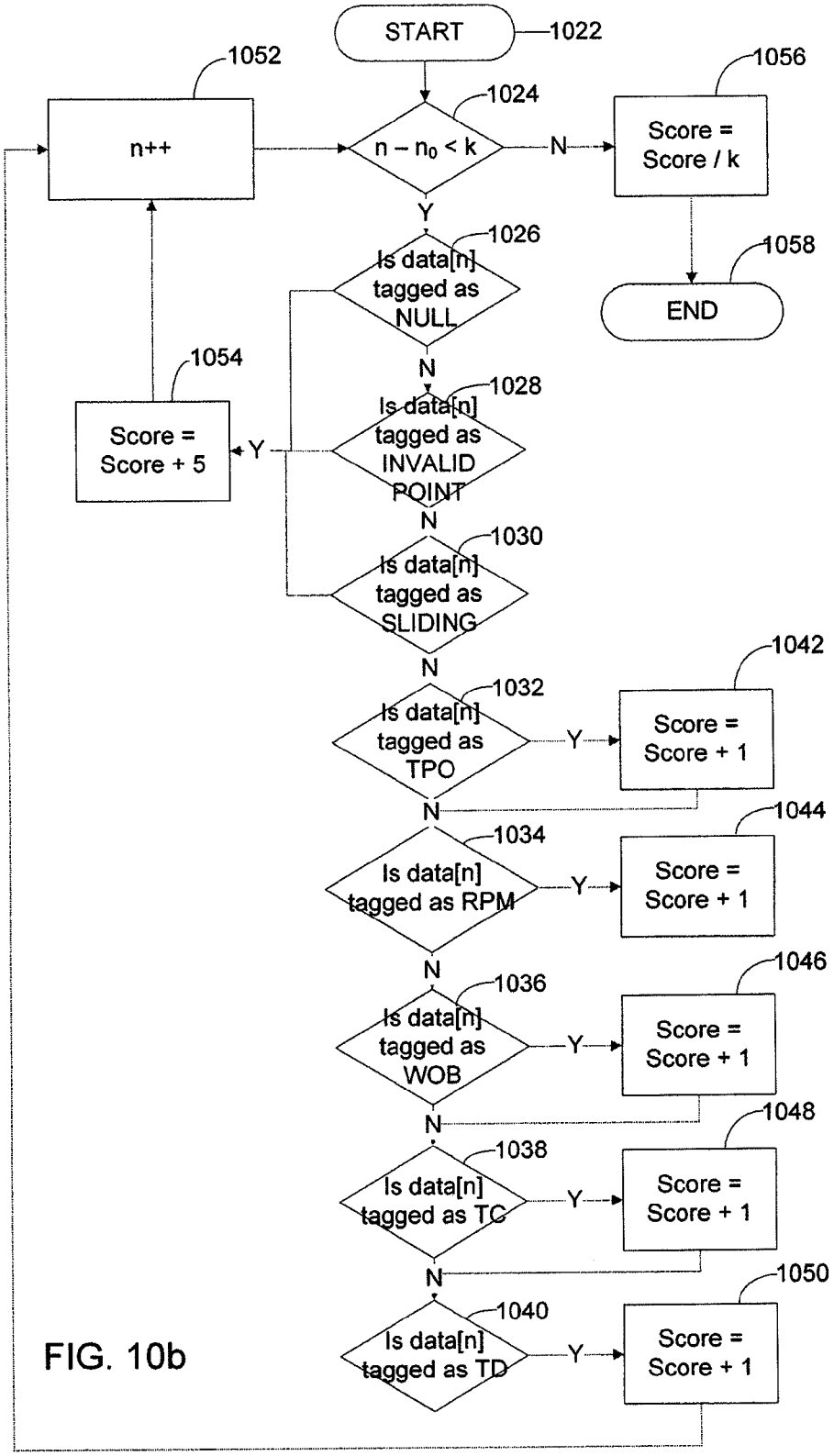

The flowcharts illustrated in FIGS. 10*a* and 10*b* depict a method that the processor executes to identify the first leg and the second leg, to assign scores to each of the first leg and the second leg to determine which of the legs contains data that should be used by the processor going forward, and deletes the leg that is not going to be used.

The processor begins at block 1000 and immediately proceeds to block 1002 to ensure that the current key value is less than the highest key value. If the current key value is not less than the highest key value, the processor proceeds to block 1022 and the method terminates. If the current key value is less than the highest key value, the processor determines whether data[n] is tagged as DUPLICATE. If not, then the depth value recorded at the current key value is not repeated elsewhere in data[n], so the processor immediately increments the key value (block 1020) and returns to block 1002.

If data[n] is tagged as DUPLICATE, however, then the depth value recorded at the current key value is repeated elsewhere in data[n]. At block 1006, the processor identifies the first leg of which data[n] forms a part, and the second leg that is duplicative of the first leg; the first leg is composed of the points that are tagged as DUPLICATE. At block 1008, the processor calculates a score for each leg, as described in more detail with respect to FIG. 10*b* below. The higher the score, the less likely the data in the leg is to be usable.

The processor then determines whether the score of the first leg is larger than the score of the second leg by a pre-determined threshold, which in the present embodiment is 70% (block 1010) and, if so, deletes the data points associated with the first leg (block 1018). If the score of the first leg is not sufficiently large relative to the score of the second leg, the processor determines whether the score of second leg is larger than the score of the first leg by the pre-determined threshold (block 1012) and, if so, deletes the data points associated with the second leg (block 1016). If the scores of the first and second legs are close enough that neither the pre-determined thresholds of blocks 1010 and 1012 are met, the processor prompts the user to select which of the legs to delete (block 1014) and subsequently deletes the points of the chosen leg (block 1015).

Following deletion of one of the legs in blocks 1015, 1016, or 1018, the processor proceeds to the next key value at block 1020 and returns to block 1002.

Referring now to FIG. 10*b*, there is depicted a method that the processor executes to calculate the score of the first and second legs in block 1008 of FIG. 10*a*. The processor begins at block 1022 and proceeds to block 1024 where it determines whether the end of the leg being considered has been reached. In block 1024, $n_0$ refers to the key value at the start of the leg and k refers to the number of key values over which the leg spans. If so, the processor calculates the average score per key value in the leg at block 1056 and then exits the method used to calculate the score at block 1058. If not, the processor then proceeds to blocks 1026, 1028 and 1030 where it determines whether data[n] is tagged as either NULL, INVALID POINT, or SLIDING. If data[n] is tagged as any of these, the score is incremented by the maximum possible score of five (block 1054), n is incremented by one (block 1052), and the processor returns to block 1024 to consider the data points at the next key value. The processor then proceeds through blocks 1032 through 1050 where the score for data[n] is incremented by one for each TPO, RPM, WOB, TC and TD tag. Following block 1050, n is incremented by one (block 1052) and the processor returns to block 1024 to consider the data points at the next key value. Although in the present embodiment a specific scoring function is used, in alternative embodiments a more generic scoring function may be used that, for example, assigns different point scores based on different tags, or that scores the legs based on positive indicators of data accuracy instead of the tags of the present embodiment that are indicators or inaccuracy.

Jump Points

Figure 11:
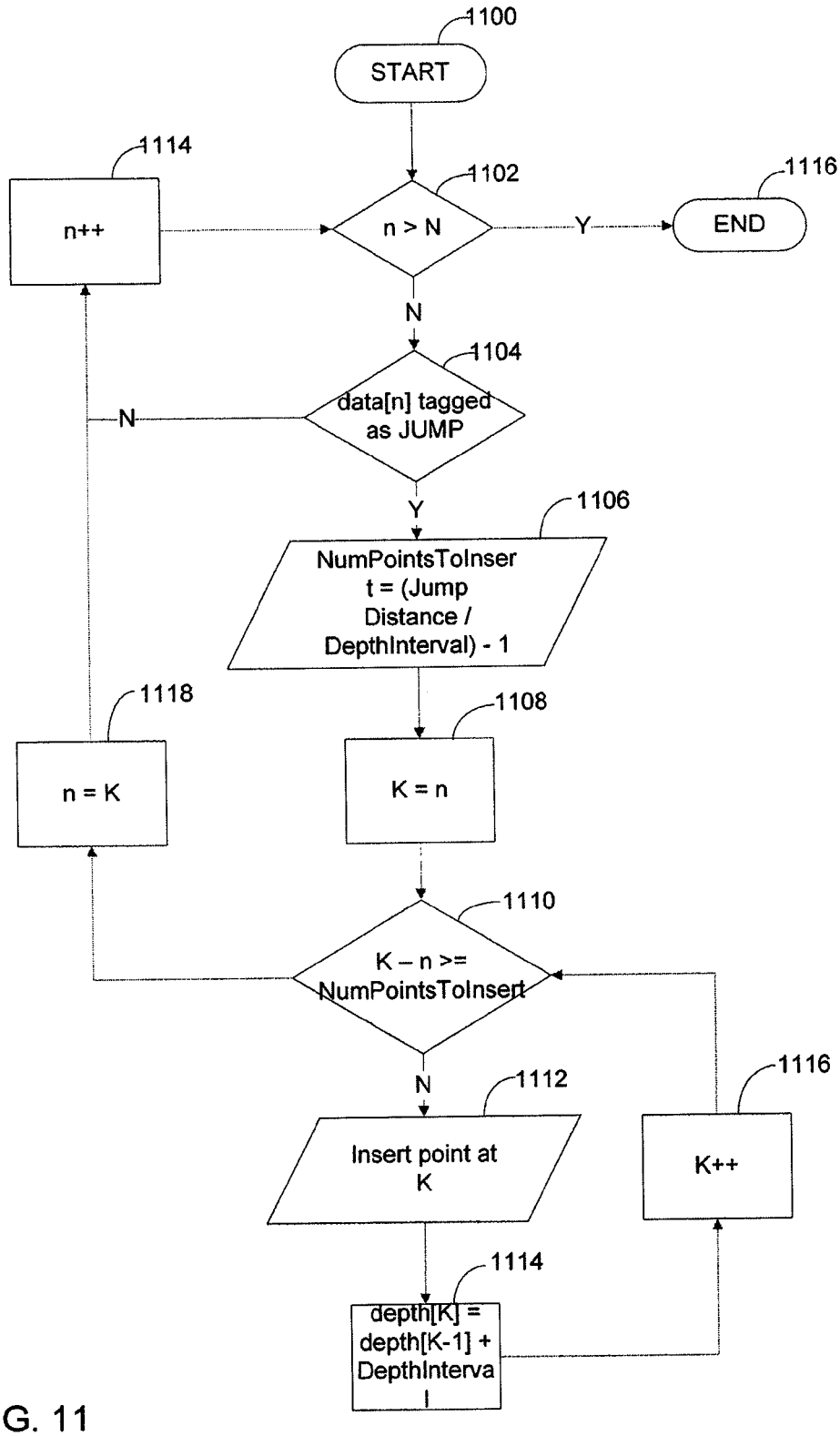
FIG. 11 is a flowchart describing a method by which jump data points are identified and corrected in the data points.

The flowcharts depicted in FIG. 11 illustrate a method that the processor executes to identify and correct jump points that are contained within data[n]. The processor begins at block 1100 and initializes the key value to one. At block 1102 the processor determines whether the current key value is greater than the highest key value; if yes, no further data points are available to check and the method ends at block 1116. If the current key value is less than the highest key value, the processor proceeds to block 1104 to see if data[n] is tagged as JUMP. If not, the processor increments the key value at block 1114 and returns to block 1102. If data[n] is tagged as JUMP, the processor inserts the number of data points that are missing over the distance of the jump. For example, in the present embodiment the DepthInterval is 0.2 meters; that is, the data recording device 31 acquires a data reading every 0.2 meters. If the jump distance is 2.4 meters, then the processor determines that the number of points to insert (NumPointsToInsert) is (2.4/0.2)−1=11 (block 1106). Following block 1106, the processor has identified that data[n] is a jump point and that NumPointsToInsert are to be inserted prior to the jump point to correct it. From blocks 1108 to 1116, the processor corrects the jump point by inserting NumPointsToInsert data points into data[n] prior to the key value at which data[n] is tagged as JUMP. Aside from depth[n], which is incremented by the DepthInterval, the inserted data[n] parameters are identical to the data[n] parameters at the key value immediately prior to the data[n] tagged as JUMP. Following insertion of NumPointsToInsert data points, the key value is reset to account for the inserted points (block 1118), is incremented (block 1114), and the processor returns to block 1102.

Table 8, below, shows the effect of the identify and correct rule as applied to the data tagged as JUMP in Table 5.

TABLE 8

Effect of Applying Jump Identify and Correct Rule to Data Tagged as JUMP in Table 5

| DEPTH | RPM | WOB | ROP | TPO | YYMMDD | HHMMSS | ACTION |
|---|---|---|---|---|---|---|---|
| 24.4 | 57 | 6.2 | 11 | 1.09 | 50612 | 62710 | |
| 24.6 | 76 | 5.9 | 17.7 | 1.09 | 50612 | 62751 | |
| 24.8 | 76 | 5.9 | 17.7 | 1.09 | 50612 | 62751 | INSERTED (from 24.6 m) |
| 25 | 76 | 5.9 | 17.7 | 1.09 | 50612 | 62751 | INSERTED (from 24.6 m) |
| 25.2 | 76 | 5.9 | 17.7 | 1.09 | 50612 | 62751 | INSERTED (from 24.6 m) |
| 25.4 | 111 | 5.9 | 6.5 | 1.37 | 50612 | 70748 | |
| 25.6 | 103 | 2.5 | 17.7 | 1.36 | 50612 | 70829 | |
| 25.8 | 110 | 3.5 | 9.7 | 1.36 | 50612 | 70941 | |

In Table 8, the processor has added three entries to data[n]. The entries in data[n] for depths 24.8 m, 25 m, and 25.2 m are identical, except in depth[n], to the parameters of data[n] measured at a depth of 24.6 m.

Table 9, below, is another sample of data[n] values that has applied to it various tags:

TABLE 9

Example of Data[n] with Various Tags

| | | | | | | | |
|---|---|---|---|---|---|---|---|
| 23 | 58 | 5.7 | 25.6 | 1.09 | 50612 | 62023 | |
| 23.2 | 56 | 5.6 | 14.3 | 1.09 | 50612 | 62114 | |
| 23.4 | 55 | 6.2 | 53.5 | 1.09 | 50612 | 62127 | |
| 23.6 | 55 | 6.9 | 9.1 | 1.09 | 50612 | 62244 | |
| 23.8 | 56 | 5.9 | 11.2 | 1.09 | 50612 | 62349 | IP |
| 24 | 57 | 5.7 | 8.9 | 1.09 | 50612 | 62511 | IP |
| 24.2 | 56 | 5.4 | 13.3 | 1.09 | 50612 | 62606 | IP |
| 24.4 | 57 | 6.2 | 11 | 1.09 | 50612 | 62710 | IP |
| 24.6 | 76 | 5.9 | 17.7 | 1.09 | 50612 | 62751 | IP RPM(33%) |
| 25.4 | 111 | 5.9 | 6.5 | 1.37 | 50612 | 70748 | J(0.8 m) RPM(46%) TPO(26%) TC(441%) |
| 25.6 | 103 | 2.5 | 17.7 | 1.36 | 50612 | 70829 | W(58%) |
| 25.8 | 110 | 3.5 | 9.7 | 1.36 | 50612 | 70941 | W(40%) |

Table 10, below, shows the effect of the jump identify and correct rule as applied to the data tagged as JUMP in Table 9.

TABLE 10

Effect of Applying Jump Identify and Correct Rule to Data of Table 9

| | | | | | | | |
|---|---|---|---|---|---|---|---|
| 23 | 58 | 5.7 | 25.6 | 1.09 | 50612 | 62023 | |
| 23.2 | 56 | 5.6 | 14.3 | 1.09 | 50612 | 62114 | |
| 23.4 | 55 | 6.2 | 53.5 | 1.09 | 50612 | 62127 | |
| 23.6 | 55 | 6.9 | 9.1 | 1.09 | 50612 | 62244 | |
| 23.8 | 56 | 5.9 | 11.2 | 1.09 | 50612 | 62349 | |
| 24 | 57 | 5.7 | 8.9 | 1.09 | 50612 | 62511 | |
| 24.2 | 56 | 5.4 | 13.3 | 1.09 | 50612 | 62606 | |
| 24.4 | 57 | 6.2 | 11 | 1.09 | 50612 | 62710 | |
| 24.6 | 76 | 5.9 | 17.7 | 1.09 | 50612 | 62751 | |
| 24.8 | 55 | 6.9 | 9.1 | 1.09 | 50612 | 62244 | INSERTED (from 23.6 m) |
| 25 | 55 | 6.9 | 9.1 | 1.09 | 50612 | 62244 | INSERTED (from 23.6 m) |
| 25.2 | 55 | 6.9 | 9.1 | 1.09 | 50612 | 62244 | INSERTED (from 23.6 m) |
| 25.4 | 111 | 5.9 | 6.5 | 1.37 | 50612 | 70748 | |
| 25.6 | 103 | 2.5 | 17.7 | 1.36 | 50612 | 70829 | |
| 25.8 | 110 | 3.5 | 9.7 | 1.36 | 50612 | 70941 | |

In Table 10, the source of the inserted parameters is from the parameters sampled at 23.6 m, which is the value of data[n] closest to the data[n] tagged as JUMP in Table 9 that is not tagged as an INVALID POINT.

Null Points

Figure 13:
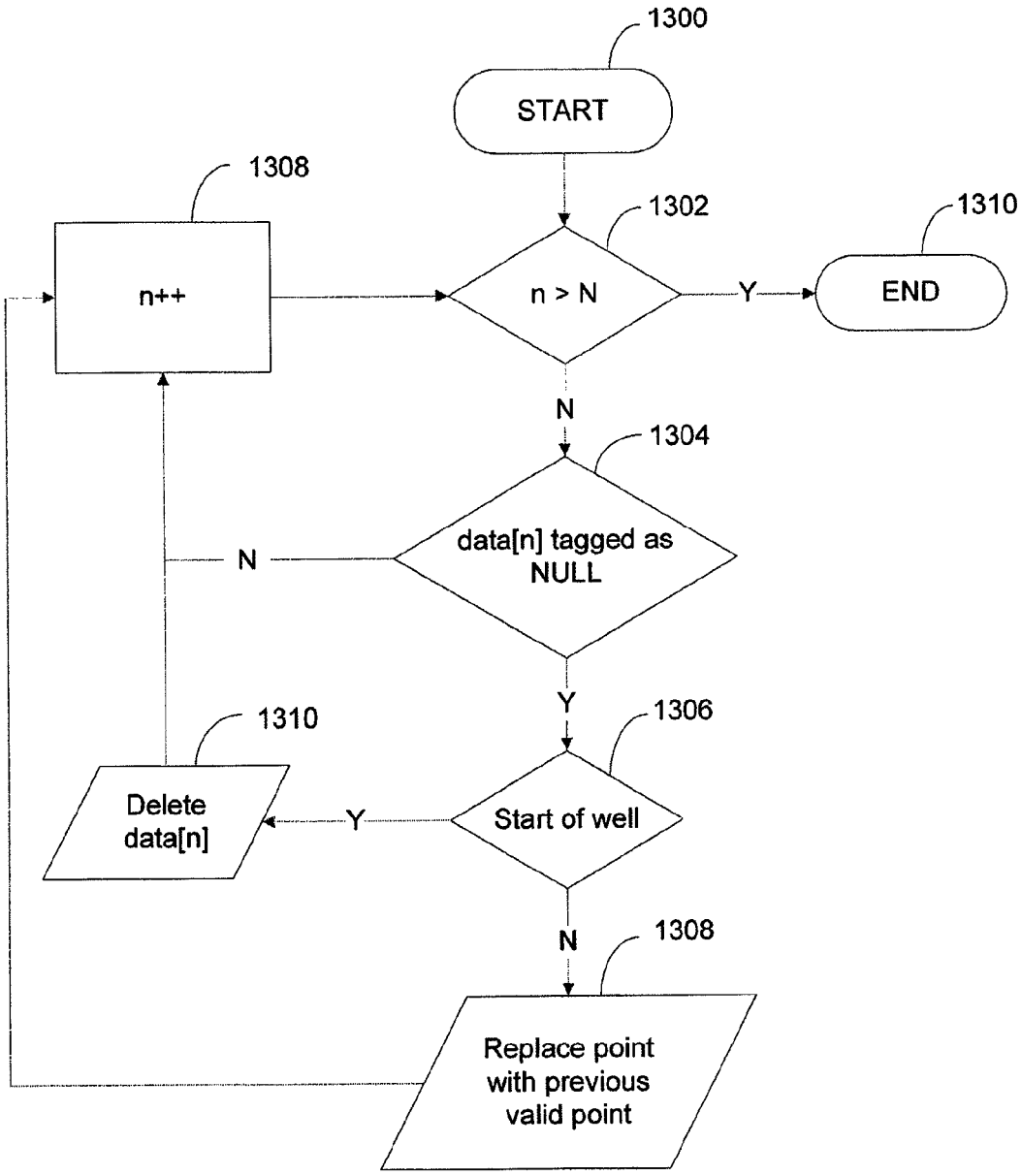
FIG. 13 is a flowchart describing a method by which null data points are identified and corrected in the data points.

Referring now to FIG. 13, there is depicted a flowchart of a method that the processor uses to identify and correct null points that are contained within data[n]. The processor begins at block 1300 and proceeds to block 1302 where it checks to determine whether the current key value is less than the highest key value; if not, no further data points are available to check and the method ends at block 1310. If the current key value is less than the highest key value, the processor proceeds to block 1304 where it checks to see if data[n] is tagged as NULL.

If so, the processor then determines whether data[n] corresponds to data recorded at the start of the drilling and, if so, deletes data[n] (blocks 1306 and 1310). This is done because data associated with the start of drilling can be inaccurate due to initialization procedures of the data recording device 31. Following deletion the key value is incremented (block 1312) and the processor returns to block 1302.

If data[n] was not recorded at the start of drilling, the processor replaces it with the previous value of data[n] that is not tagged as NULL, INVALID or SLIDING (block 1308). The processor subsequently increments the key value by one (block 1312) and returns to block 1302 to identify whether the next value of data[n] is null and to correct it if necessary.

Invalid Points

Figure 14:
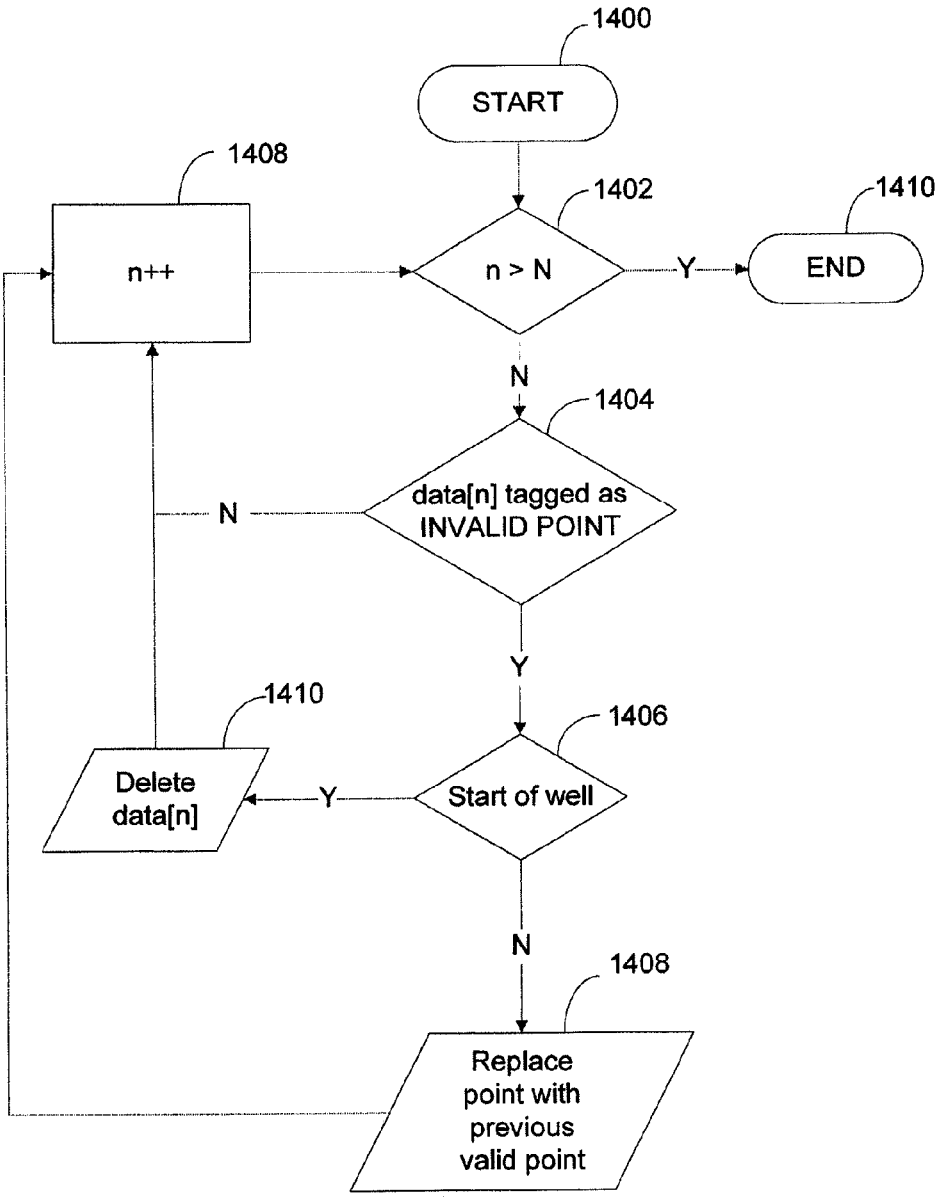
FIG. 14 is a flowchart describing a method by which invalid data points are identified and corrected in the data points.

Referring now to FIG. 14, there is depicted a flowchart of a method that the processor uses to identify and correct invalid points that are contained within data[n]. The processor begins at block 1400 and proceeds to block 1402 where it checks to determine whether the current key value is less than the highest key value; if not, no further data points are available to check and the method ends at block 1410. If the current key value is less than the highest key value, the processor proceeds to block 1404 where it checks to see if data[n] is tagged as INVALID.

If so, the processor then determines whether data[n] corresponds to data recorded at the start of the drilling and, if so, deletes data[n] (blocks 1406 and 1410). This is done because data associated with the start of drilling can be inaccurate due to initialization procedures of the data recording device 31. Following deletion the key value is incremented (block 1412) and the processor returns to block 1402.

If data[n] was not recorded at the start of drilling, the processor replaces it with the previous value of data[n] that is not tagged as NULL, INVALID or SLIDING (block 1408). The processor subsequently increments the key value by one (block 1412) and returns to block 1402 to identify whether the next value of data[n] is null and to correct it if necessary.

Sliding Points

Figure 15:
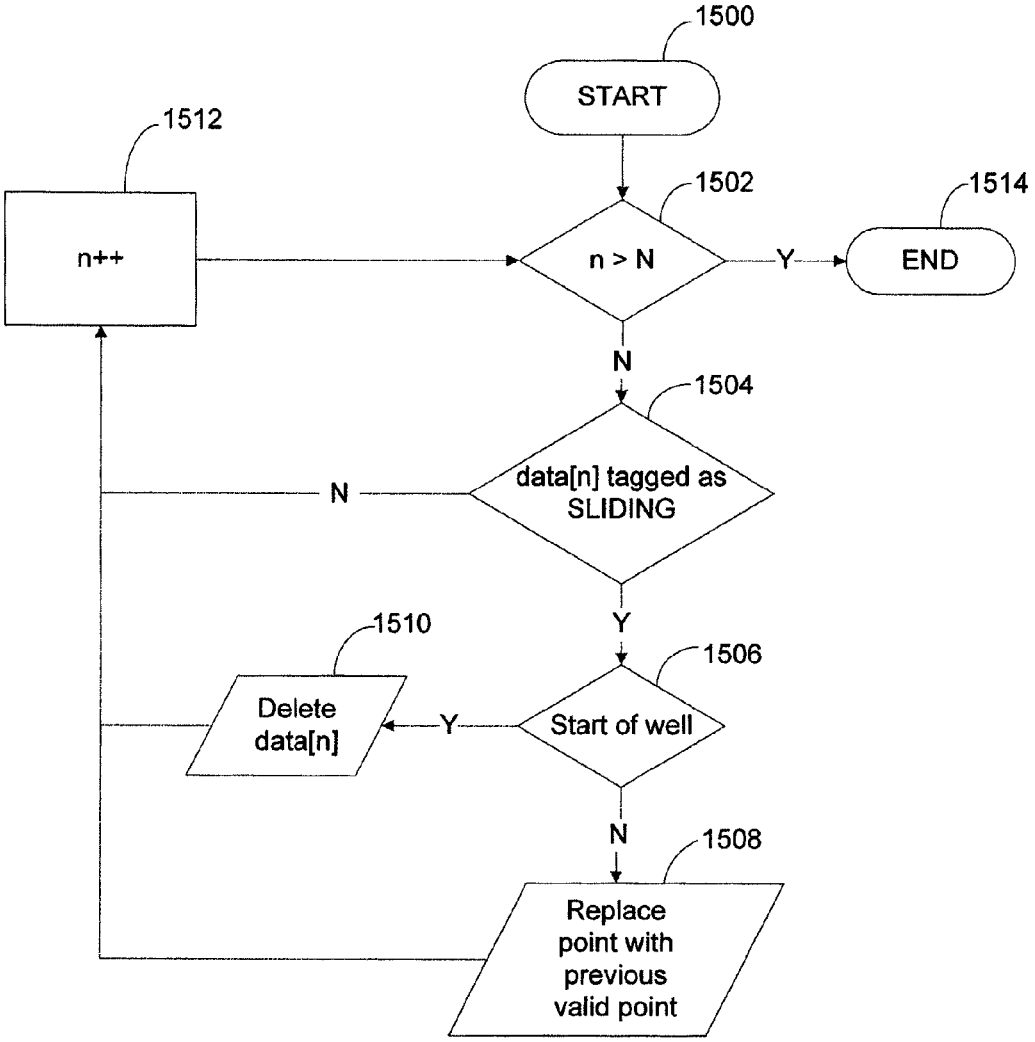
FIG. 15 is a flowchart describing how sliding data points are identified and corrected in the data points.

Referring now to FIG. 15, there is depicted a flowchart of a method that the processor uses to identify and correct sliding points that are contained within data[n]. The processor begins at block 1500 and proceeds to block 1502 where it checks to determine whether the current key value is less than the highest key value; if not, no further data points are available to check and the method ends at block 1514. If the current key value is less than the highest key value, the processor proceeds to block 1504 where it checks to see if data[n] is tagged as SLIDING.

If so, the processor then determines whether data[n] corresponds to data recorded at the start of the drilling and, if so, deletes data[n] (blocks 1506 and 1510). This is done because data associated with the start of drilling can be inaccurate due to initialization procedures of the data recording device 31. Following deletion the key value is incremented (block 1512) and the processor returns to block 1502.

If data[n] was not recorded at the start of drilling, the processor replaces it with the previous value of data[n] that is not tagged as NULL, INVALID or SLIDING (block 1508). The processor subsequently increments the key value by one (block 1512) and returns to block 1502 to identify whether the next value of data[n] is null and to correct it if necessary.

In the present embodiment, a value of data[n] not tagged as NULL, INVALID or SLIDING is characterized as a "valid" point; i.e., a point indicative of useful data. In alternative embodiments, a "valid" point may be defined differently. For example, in an alternative embodiment that utilizes different tags or a different combination of the foregoing tags, a value of data[n] that is not tagged as NULL may constitute a "valid" point.

Smoothing Points

In the present embodiment, the data recording device 31 outputs one instance of data[n] every 0.2 meters, which is the depth interval between adjacent values in depth[n]. However, the data recording device 31 samples more frequently than once every 0.2 meters. Of the multiple samples the data recording device 31 acquires every 0.2 meters, the data recording device 31 outputs the largest of each of the parameters measured. For example, if four RPM readings are sampled during a 0.2 meter depth interval of 20 rotations per minute, 30 rotations per minute, 35 rotations per minute and 40 rotations per minute, the data recording device 31 outputs 40 rotations per minute as the RPM reading for that depth interval. Consequently, in order to have the data[n] values better approximate the well 18 as drilled, each of WOB[n], RPM[n], TPO[n], ROP[n], TD[n] and TC[n] in data[n] can be smoothed, or averaged, downwards. In the discussion that follows, each of WOB[n], RPM[n], TPO[n], ROP[n], TD[n] and TC[n] is generically referred to as X[n], and X[n] is smoothed by comparing it to X[n−1] and X[n+1] as follows.

Figure 12:
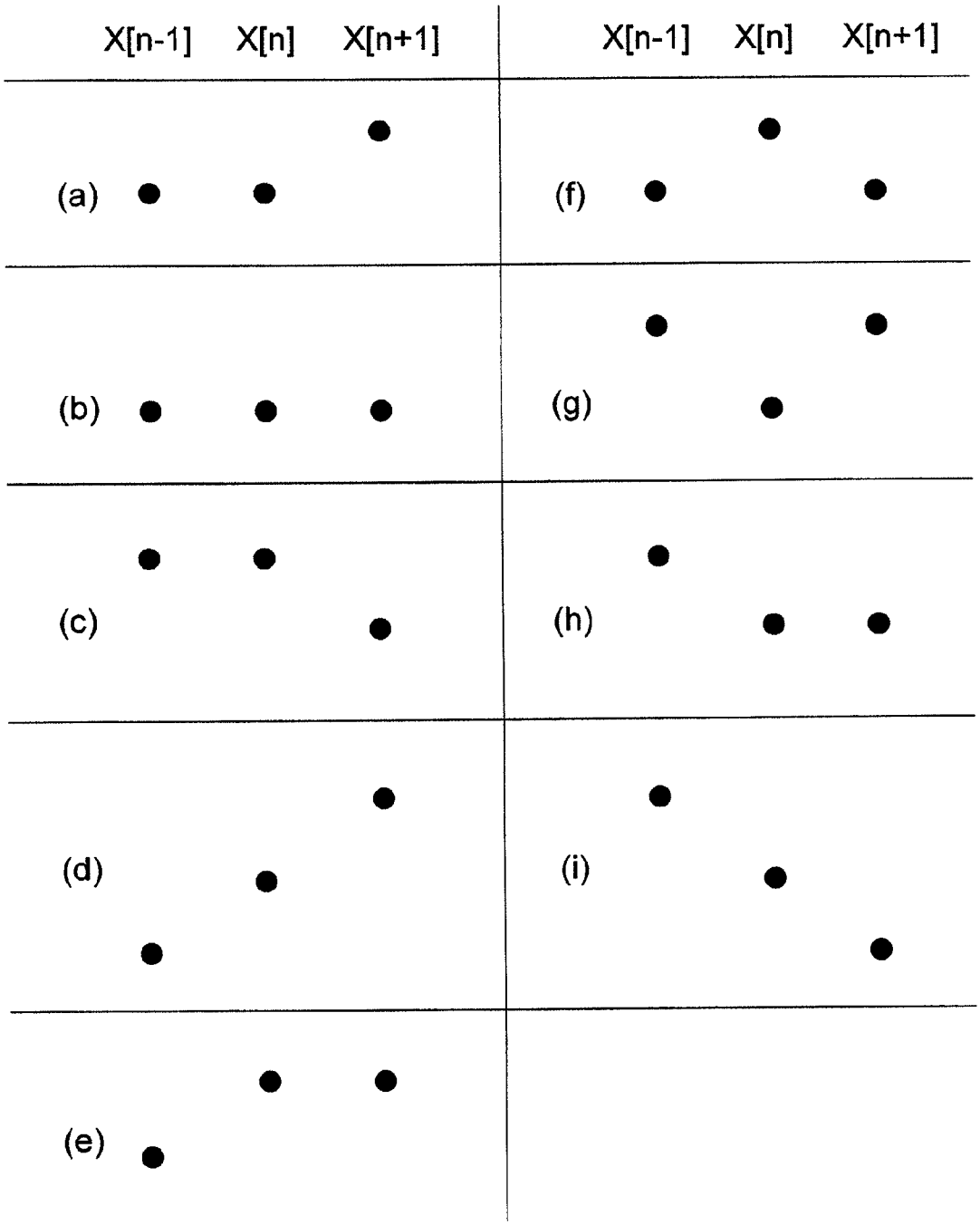
FIGS. 12*a* through 12*i* depict various sequences of data points that can be corrected through smoothing.

Referring now to FIG. 12, there is depicted the possible transitions from X[n−1] to X[n] and from X[n] to X[n+1] as summarized in Table 11. Table 11 also describes how the processor performs smoothing on X[n] depending on how X[n] compares to X[n−1] and X[n+1].

TABLE 11

Description of How Smoothing is Performed on X[n] Based on X[n − 1] and X[n + 1]

| Figure | How X[n] Compares to X[n − 1] | How X[n] Compares to X[n + 1] | Formula Applied to X[n] for Smoothing |
|---|---|---|---|
| 12(a) | X[n] and X[n − 1] are Identical | X[n] is lower than X[n + 1] | X[n] = X[n] |
| 12(b) | X[n] and X[n − 1] are Identical | X[n] and X[n + 1] are Identical | X[n] = X[n] |
| 12(c) | X[n] and X[n − 1] are Identical | X[n] is greater than X[n + 1] | X[n] = (X[n] + X[n + 1])/2 |
| 12(d) | X[n] is greater than X[n − 1] | X[n] is lower than X[n + 1] | X[n] = X[n] |
| 12(e) | X[n] is greater than X[n − 1] | X[n] and X[n + 1] are Identical | X[n] = (X[n − 1] + X[n])/2 |
| 12(f) | X[n] is greater than X[n − 1] | X[n] is greater than X[n + 1] | X[n] = (X[n − 1] + X[n] + X[n + 1])/3 |
| 12(g) | X[n] is lower than X[n − 1] | X[n] is lower than X[n + 1] | X[n] = X[n] |
| 12(h) | X[n] is lower than X[n − 1] | X[n] and X[n + 1] are Identical | X[n] = X[n] |
| 12(i) | X[n] is lower than X[n − 1] | X[n] is greater than X[n + 1] | X[n] = X[n] |

For example, if X[n−1] equals 14, X[n] equals 17, and X[n+1] equals 12, the situation in FIG. 12(*f*) applies and X[n] is modified to (14+17+12)/3=43/3. In the present embodiment, all points in data[n] are smoothed according to the method described in Table 11; however in alternative embodiments only a smaller subset of the data points may be smoothed.

Example of Operation

In order to correct an array of data points, the processor first analyzes each of the data points across all key values of data[n] and applies tags where called for according to the methods described in FIGS. 2, 3, 4, 6, 7 and 9. In the present embodiment, as some of the methods in FIGS. 2, 3, 4, 6, 7 and 9 utilize tags earlier applied to data[n], the order of execution of the methods can be important. One exemplary order in which the tags can be applied is as follows:

FIG. 2 can be executed to apply the NULL tags;

FIG. 3 can be executed to apply the TD, TC, WOB, RPM and TPO tags;

FIG. 4 can be executed to apply the SLIDING tags;

FIG. 7 can be executed to apply the JUMP tags;

FIG. 6 can be executed to apply the DUPLICATE tags; and

FIG. 9 can be executed to apply the INVALID tags.

Following application of the tags, the processor can proceed to identify and correct the data faults. As mentioned above, the logic used to identify the data faults can vary in complexity. For example, to identify certain data faults the processor may simply note that applying a certain tag to data[n] is tantamount to identifying data[n] as being a data fault of a certain type. For example, in present embodiment if data[n] is tagged as NULL, SLIDING or INVALID, then data[n] is subsequently identified as a null data point, a sliding data point, or an invalid data point, respectively. However, this is not the case for other data faults. For example, when data[n] is tagged as DUPLICATE, the processor does not identify only data[n] at a single key value as being duplicate data points, but identifies the related first and second legs as being related duplicate data points, as described above in respect of FIG. 10. Similarly, when data[n] is tagged as JUMP, the processor does not identify only data[n] at a single key value as being a jump point, but also identifies the number of points to be inserted into data[n] so as to be able to correct the jump point, as described above in FIG. 11. Additionally, some data faults do not have directly corresponding tags at all; these include truncation points, problematic points, and smoothing points.

As with application of tags, in the present embodiment the order in which the identify and correct methods are applied can be important. One exemplary order in which identify and correct can be applied is as follows:

Identify the null points and the sliding points, and identify and correct the truncation points;

Identify and correct both the duplicate points and the jump points;

Identify and correct the problematic points;

Correct the null points;

Identify and correct the invalid points; and

Identify and correct the smoothing points and correct the sliding points.

Depending on the specifics of the logic employed in alternative embodiments, the order in which one or both of tags are applied and identify and correct methods are called may be different or immaterial.

Figure 16A:
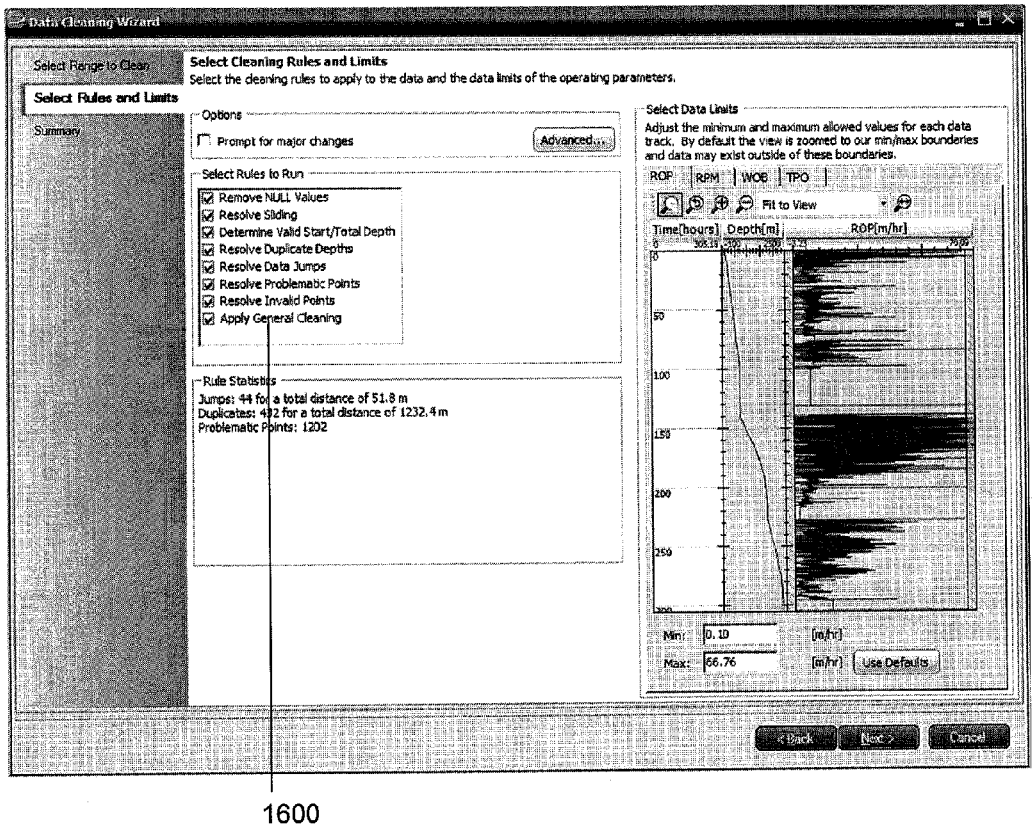
FIGS. 16*a* and 16*b* are screenshots of a graphical user interface for correcting data points acquired during well drilling.
Figure 16B:
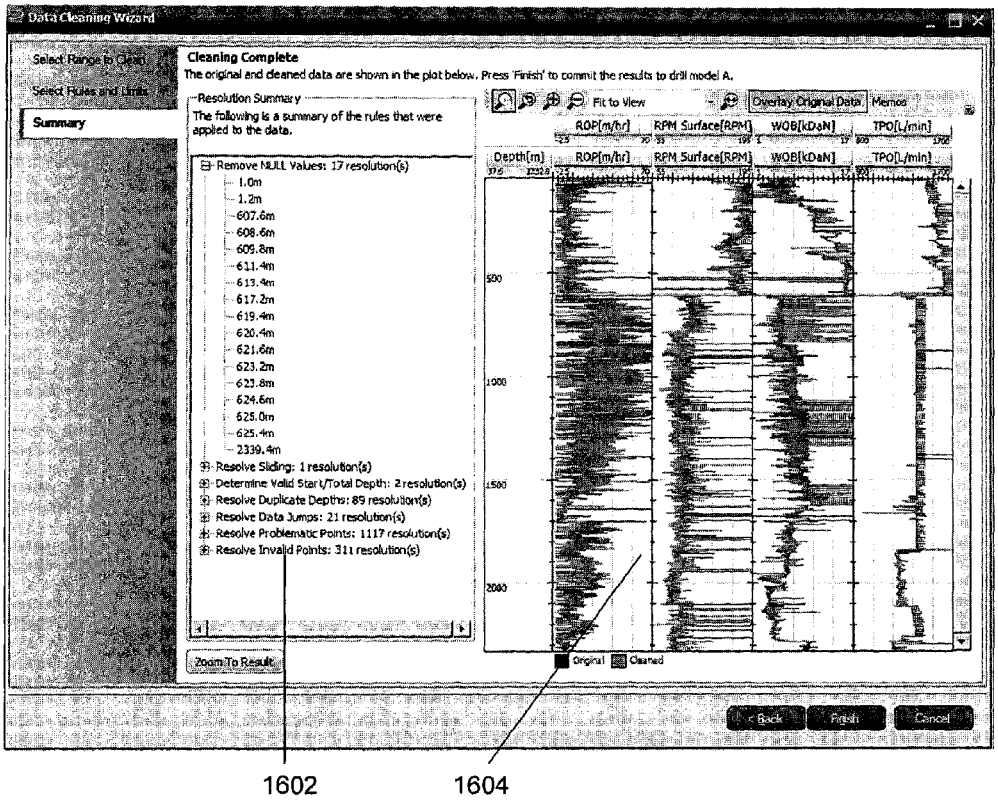

Notably, the processor does not need to apply all of the identify and correct methods as described above. For example, a user can through a graphical user interface select which of the identify and correct methods will be employed. Such a graphical user interface is displayed in FIGS. 16*a* and 16*b*. In particular, a pane 1600 in FIG. 16*a* allows a user to select which of the identify and correct methods are to be applied to the data points. Another pane 1602 in FIG. 16*b* summarizes the results of the application of the identify and correct methods. A third pane 1604 overlays uncorrected and corrected data points.

Beneficially, the use of tags allows the processor to access the data characteristics signified by the tags throughout the entirety of the identifying and correcting process. If the data were to be identified and corrected without the use of tags, some of the original data could be lost following initial correction of the data points, which could hinder subsequent data processing. For example, in the foregoing embodiments data [n] that is tagged as NULL remains tagged as NULL even after the null points are identified and corrected. The NULL tag is used even after identification and correction of the null points; for example, the NULL tag is used when determining whether a data point is one of the "valid" points during correction of the sliding points. If tagging were not used, following correction of the null points there would be no indication of what points were originally identified as being the null points, and during correction of the sliding points the processor would not be able to determine which of the data points are the "valid" points.

For the sake of convenience, the embodiments above are described as various interconnected functional blocks or distinct software modules. This is not necessary, however, and there may be cases where these functional blocks or modules are equivalently aggregated into a single logic device, program or operation with unclear boundaries. In any event, the functional blocks and software modules or features of the flexible interface can be implemented by themselves, or in combination with other operations in either hardware or software.

While particular embodiments have been described in the foregoing, it is to be understood that other embodiments are possible and are intended to be included herein. It will be clear to any person skilled in the art that modifications of and adjustments to the foregoing embodiments, not shown, are possible.

The invention claimed is:

1. A computer implemented method for correcting data points acquired during well drilling, the method comprising:

(a) reading, using a processor, the data points from a computer readable medium, wherein the data points represent at least one of hole depth of a well, rate of penetration of a drill bit used to drill the well, depth of the drill bit, on bottom rate of penetration of the drill bit, weight on the drill bit, rotations per minute of a drill string used to drill the well as measured at surface, rotary torque applied to the drill string as measured at the surface, and total pump output of a drilling fluid pump as measured at the surface;

(b) applying, using the processor, a tag to one or more of the data points wherein the tag corresponds to a characteristic of the one or more of the data points;

(c) identifying, using the processor, a data fault indicative of inaccurate data in the one or more of the data points associated with the tag; and (d) correcting, using the processor, the data fault.

2. A method as claimed in claim 1 wherein multiple tags are applied to the one or more of the data points, each of the tags corresponding to a different characteristic of the one or more of the data points.

3. A method as claimed in claim 1 wherein applying a tag comprises applying a null tag to any one or more of the data points with which no usable data is associated.

4. A method as claimed in claim 1 wherein applying a tag comprises applying a measured time difference tag to any one or more of the data points for which a difference in measured time between the one or more of the data points and a data point immediately previously recorded to the one of the data points exceeds a pre-determined measured time threshold.

5. A method as claimed in claim 1 wherein applying a tag comprises applying a calculated time difference tag to any one or more of the data points for which a difference in measured time and calculated time for the one or more of the data points exceeds a pre-determined calculated time threshold.

6. A method as claimed in claim 1 wherein applying a tag comprises applying a weight on bit tag to any one or more of the data points for which a difference in weight on bit between the one or more of the data points and a data point previously recorded to the one or more of the data points exceeds a pre-determined weight on bit threshold.

7. A method as claimed in claim 1 wherein applying a tag comprises applying a rotations per minute tag to any one or more of the data points for which a difference in rotations per minute between the one or more of the data points and a data point previously recorded to the one or more of the data points exceeds a pre-determined rotations per minute threshold.

8. A method as claimed in claim 1 wherein applying a tag comprises applying a total pump output tag to any one or more of the data points for which a difference in total pump output between the one or more of the data points and a data point previously recorded to the one or more of the data points exceeds a pre-determined total pump output threshold.

9. A method as claimed in claim 1 wherein applying a tag comprises applying a sliding tag to any one or more of the data points that were measured during sliding drilling.

10. A method as claimed in claim 1 wherein applying a tag comprises applying a duplicate tag to any one or more of the data points that have identical depth measurements.

11. A method as claimed in claim 1 wherein applying a tag comprises applying a jump tag to any one or more of the data points wherein a change in depth between the one or more of the data points and a data point immediately previously recorded to the one or more of the data points exceeds a pre-determined depth interval.

12. A method as claimed in claim 1 wherein applying a tag comprises applying an invalid tag to any one or more of the data points wherein values of rate of penetration, weight on bit or rotations per minute associated with the one or more of the data points are outside pre-determined thresholds.

13. A method as claimed in claim 1 wherein identifying a data fault comprises identifying multiple data faults, each of the data faults indicative of a different inaccuracy in the one or more of the data points associated with the tag.

14. A method as claimed in claim 2 wherein identifying a data fault comprises identifying as a null point any one of the one or more data points tagged as null.

15. A method as claimed in claim 9 wherein identifying a data fault comprises identifying as a sliding point any one of the one or more data points tagged as sliding.

16. A method as claimed in claim 12 wherein identifying a data fault comprises identifying as an invalid point any one of the one or more data points that have been tagged as invalid.

17. A method as claimed in claim 10 wherein identifying a data fault comprises identifying, from any one or more of the data points tagged as duplicate, first and second legs of duplicate points and assigning a score to the first and second legs of duplicate points indicative of data reliability.

18. A method as claimed in claim 11 wherein identifying a data fault comprises identifying as a jump point any one or more of the data points tagged as jump and determining a number of data points to be inserted prior to the jump point.

19. A method as claimed in claim 18 wherein the number of data points to be inserted equals the change in depth between the jump point and a data point immediately previously recorded to the jump point, divided by the pre-determined depth interval.

20. A method as claimed in claim 1 wherein identifying a data fault comprises identifying as a truncation point any one or more of the data points recorded at the beginning or end of drilling that are tagged as invalid, for which a measured time exceeds a pre-determined measured time threshold, or for which a difference between the measured time and a calculated time exceeds a pre-determined difference threshold, until a certain number of points that are valid, for which the measured time is within the pre-determined measured time threshold and for which the difference between the measured and calculated times is within the pre-determined difference threshold are counted.

21. A method as claimed in claim 1 wherein identifying a data fault comprises identifying as a problematic point any one or more of the data points that are indicative of a stoppage in drilling.

22. A method as claimed in claim 17 wherein correcting the data fault comprises correcting the duplicate points by deleting the one of the duplicate legs whose score is more indicative of unreliability.

23. A method as claimed in claim 18 wherein correcting the data fault comprises correcting the jump point by inserting the number of data points to be inserted of data points prior to the jump point.

24. A method as claimed in claim 23 wherein each of the data points that is inserted is identical to a valid data point recorded prior to the jump point.

25. A method as claimed in claim 21 wherein correcting the data fault comprises correcting the problematic point by replacing the problematic point with a valid data point recorded prior to the problematic point.

26. A method as claimed in claim 14 wherein correcting the data fault comprises correcting the null point by replacing the null point with a valid data point recorded prior to the null point.

27. A method as claimed in claim 15 wherein correcting the data fault comprises correcting the sliding point by replacing the sliding point with a valid data point recorded prior to the sliding point.

28. A method as claimed in claim 16 wherein correcting the data fault comprises correcting the invalid point by replacing the invalid point with a valid data point recorded prior to the invalid point.

29. A method as claimed in claim 24 wherein the valid data point comprises a data point that is not tagged as null, sliding or invalid.

30. A method as claimed in claim 29 wherein the valid data point is recorded immediately prior to the data point associated with the data fault.

31. A method as claimed in claim 1 wherein correcting the data fault comprises smoothing one or more of the data points.

32. A method as claimed in claim 1 wherein applying a tag to one or more the data points comprises applying a null tag, a measured time tag, a calculated time tag, a weight on bit tag, a rotations per minute tag, a total pump output tag, a sliding tag, a jump tag, a duplicate tag, and then an invalid tag.

33. A method as claimed in claim 1 wherein identifying and correcting the data faults comprises identifying null points and sliding points, identifying and correcting truncation points, identifying and correcting duplicate points and jump points, identifying and correcting problematic points, correcting the null points, identifying and correcting invalid points, identifying and correcting smoothing points, and then correcting the sliding points.

34. A non-transitory computer readable medium having encoded thereon statements and instructions for execution by a processor to carry out a method for correcting data points acquired during well drilling, the method comprising:

(a) reading, using the processor, the data points from a data storage device, wherein the data points represent at least one of hole depth of a well, rate of penetration of a drill bit, depth of the drill bit, on bottom rate of penetration of the drill bit, weight on the drill bit, rotations per minute of a drill string as measured at surface, rotary torque applied to the drill string as measured at the surface, and total bump output of a drilling fluid pump as measured at the surface;

(b) applying, using the processor, a tag to one or more of the data points wherein the tag corresponds to a characteristic of the one or more of the data points;

(c) identifying, using the processor, a data fault indicative of inaccurate data in the one or more of the data points associated with the tag; and (d) correcting, using the processor, the data fault.

35. An apparatus for correcting data points acquired during well drilling, the apparatus comprising:

(a) a processor; and (b) a memory communicatively coupled to the processor, the memory having encoded thereon statements and instructions for execution by the processor to carry out a method for correcting data points acquired during well drilling, the method comprising:

(i) reading, using the processor, the data points from a data storage device, wherein the data points represent at least one of hole depth of a well, rate of penetration of a drill bit, depth of the drill bit, on bottom rate of penetration of the drill bit, weight on the drill bit, rotations per minute of a drill string as measured at surface, rotary torque applied to the drill string as measured at the surface, and total pump output of a drilling fluid pump as measured at the surface;

(ii) applying, using the processor, a tag to one or more of the data points wherein the tag corresponds to a characteristic of the one or more of the data points;

(iii) identifying, using the processor, a data fault indicative of inaccurate data in the one or more of the data points associated with the tag; and (iv) correcting, using the processor, the data fault.

* * * * *